US007104359B1

(12) United States Patent
Zelinski

(10) Patent No.: US 7,104,359 B1
(45) Date of Patent: Sep. 12, 2006

(54) MUFFLER HAVING A BAFFLE WITH ANGLED PLATES

(76) Inventor: Joseph R. Zelinski, 312 First St., Neenah, WI (US) 54956

( * ) Notice: Subject to any disclaimer, the term of this patent is extended or adjusted under 35 U.S.C. 154(b) by 411 days.

(21) Appl. No.: 10/650,285

(22) Filed: Aug. 28, 2003

(51) Int. Cl.

| | |
|---|---|
| ***F01N 7/18*** | (2006.01) |
| ***F01N 1/02*** | (2006.01) |
| ***B21D 51/16*** | (2006.01) |
| *F01N 1/08* | (2006.01) |
| *B21D 51/06* | (2006.01) |
| *B21D 51/10* | (2006.01) |
| *B23P 17/02* | (2006.01) |

(52) U.S. Cl. ..... 181/264; 181/268; 181/269; 181/272; 181/275; 181/282; 181/238; 29/890.08

(58) Field of Classification Search ..... 181/264, 181/268, 269, 272, 275, 282, 281, 239, 238, 181/249, 251, 255, 227, 228
See application file for complete search history.

(56) References Cited

U.S. PATENT DOCUMENTS

| | | | | |
|---|---|---|---|---|
| 3,100,140 A | | 8/1963 | Ashley et al. | 23/288 |
| 3,724,591 A | * | 4/1973 | Malkiewicz | 181/265 |
| 4,064,963 A | * | 12/1977 | Kaan et al. | 181/244 |
| 4,133,479 A | * | 1/1979 | Musitano et al. | 237/12.3 A |
| 4,416,350 A | * | 11/1983 | Hayashi | 181/272 |
| 5,196,655 A | | 3/1993 | Woods | 181/235 |
| 5,739,483 A | * | 4/1998 | Yashiro et al. | 181/254 |
| 5,949,035 A | * | 9/1999 | Herold | 181/282 |
| 5,984,045 A | * | 11/1999 | Maeda et al. | 181/254 |
| 6,207,116 B1 | * | 3/2001 | Heed | 422/173 |
| 6,290,557 B1 | * | 9/2001 | Yokoya | 440/89 R |
| 6,415,889 B1 | | 7/2002 | Wyatt | 181/282 |
| 6,457,554 B1 | * | 10/2002 | Wang | 181/282 |
| 6,609,590 B1 | * | 8/2003 | Zelinski | 181/281 |

* cited by examiner

*Primary Examiner*—Edgardo San Martin
(74) *Attorney, Agent, or Firm*—Donald J. Ersler

(57) ABSTRACT

A muffler having a baffle with angled plates includes a one piece baffle, a container and two end caps. The one piece baffle has at least three different configurations. The baffle preferably has two, three or four plates, namely "V", "Z" or "W" shapes. Each one piece baffle configuration includes openings to allow exhaust flow therethrough. Each one piece baffle configuration is retained in the container. The container is terminated with end caps on each end thereof. At least one inlet tube and at least one outlet tube are attached to a perimeter of the container. In a second embodiment, the container and baffle are formed from a single piece of material. In a third and fourth embodiment, the inlet and outlet tubes are inserted through plates of the baffle. In a fifth embodiment, balanced tubes and chambers are added. In a sixth embodiment, a corrugated baffle is used.

34 Claims, 20 Drawing Sheets

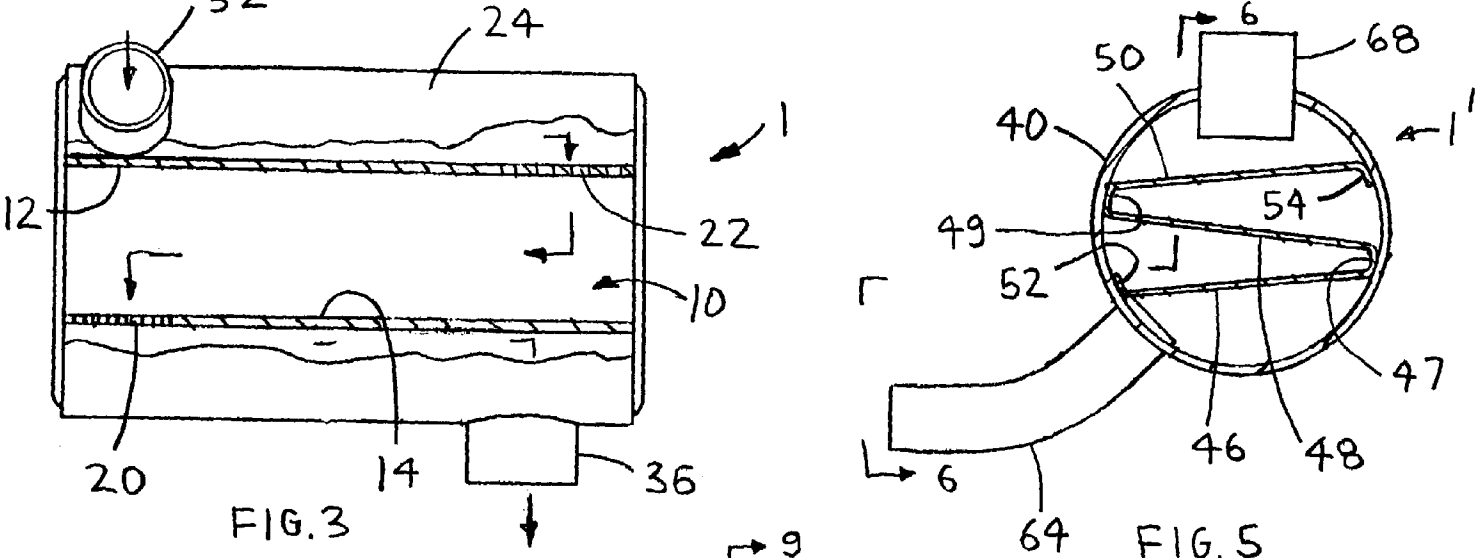
FIG.3
FIG.5
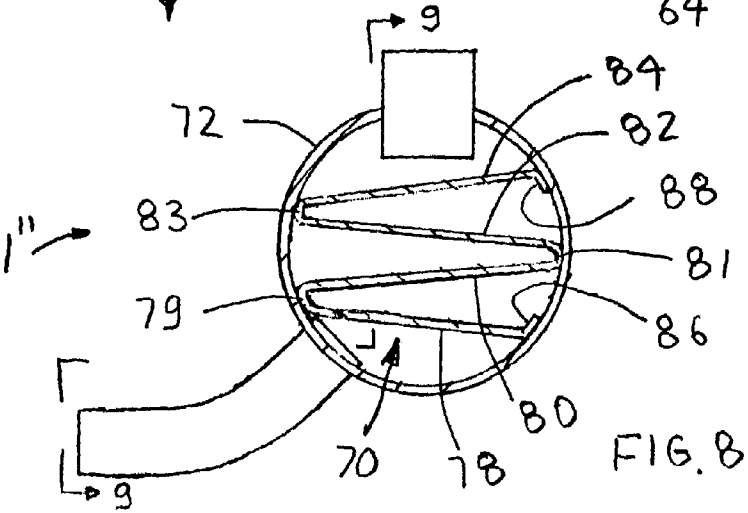
FIG.8

2
2'
2''
112
116
119
114
118
120
122
124
128
130
131
132
133
134
136
126
138
140
142
144
145
146
147
148
149
150
152

FIG. 31
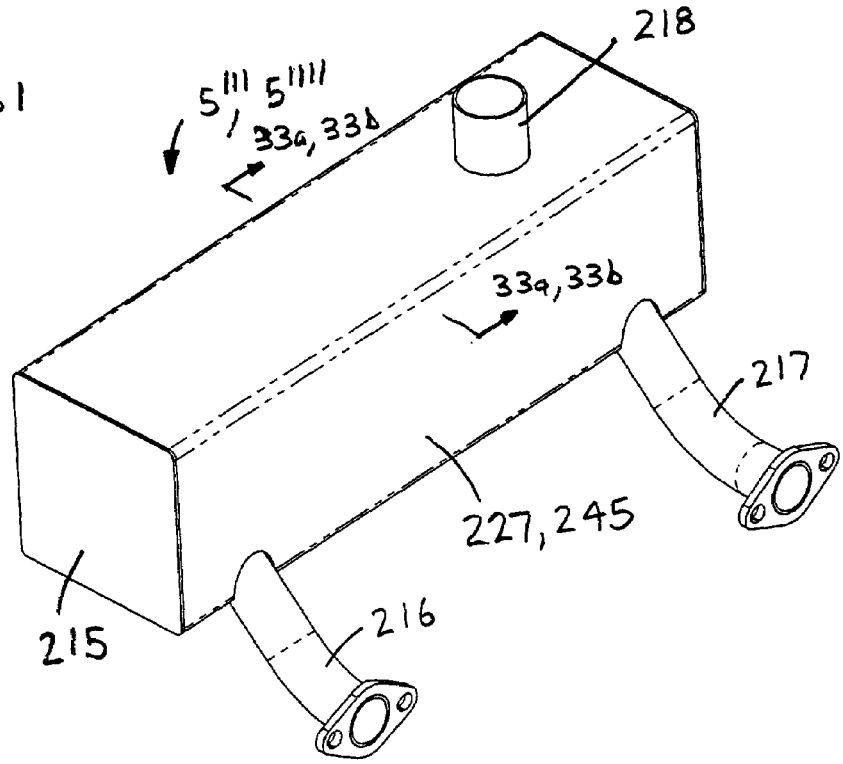
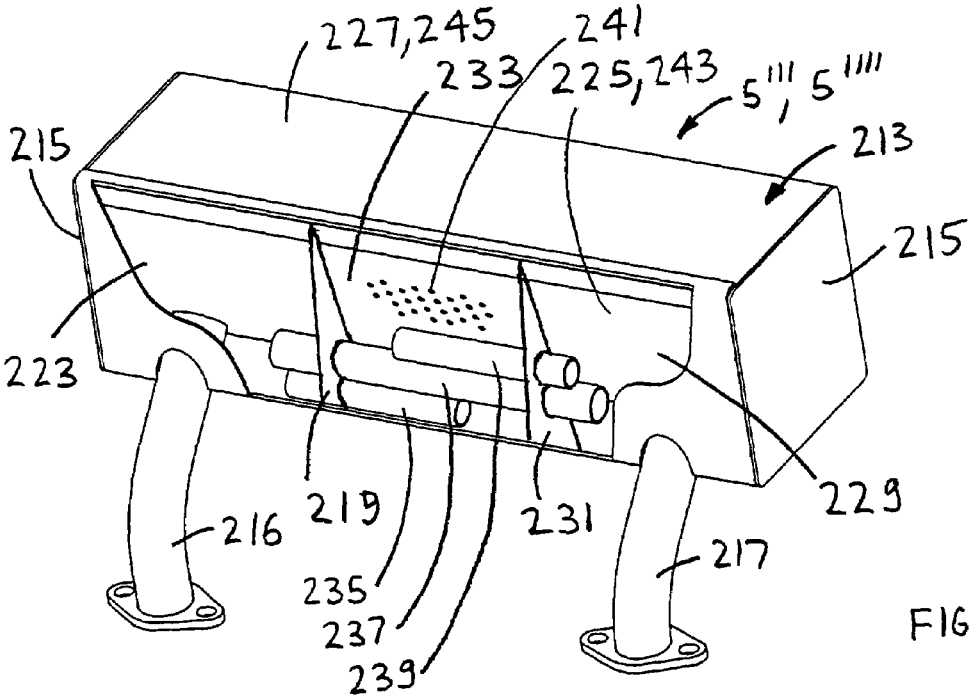
FIG. 32

MUFFLER HAVING A BAFFLE WITH ANGLED PLATES

BACKGROUND OF THE INVENTION

1. Field of the Invention

The present invention relates generally to mufflers and more specially to a muffler having a baffle with angled plates that reduces assembly complexity.

2. Discussion of the Prior Art

The prior art provides numerous designs of engine mufflers. Some of these prior art mufflers include U.S. Pat. No. 3,100,140 to Ashley et al., U.S. Pat. No. 5,196,655 to Woods and U.S. Pat. No. 6,415,889 to Wyatt. The Ashley et al. patent discloses a catalytic automotive exhaust converter. The converter is fabricated from a single casing, two end caps, an inlet pipe and an exhaust pipe. The casing includes a plurality of corrugations, which would require expensive tooling to produce. The Woods patent discloses a muffler for a marine engine. The muffler includes two baffle components, a can, two end caps, an inlet pipe and an outlet pipe. The Wyatt patent includes a formed piece of metal and two end caps. First and second serpentine half tubes are formed in the formed piece of metal.

Accordingly, there is a clearly felt need in the art for a muffler having a baffle with angled plates, which provides reduced assembly complexity and quieter performance.

SUMMARY OF THE INVENTION

The present invention provides a muffler having a baffle with angled plates that provides quieter performance. The muffler having a baffle with angled plates (muffler with baffle) includes a one piece baffle, a container and two end caps. The one piece baffle includes at least three different configurations: V, Z and W. The V-baffle includes a single plate bent into two angled plates in the shape of a "V." The Z-baffle includes a single plate bent into three angled plates in the shape of a "Z." The W-baffle includes a single plate bent into four angled plates in the shape of a "W."

Each one piece baffle configuration includes openings to allow exhaust flow therethrough. The openings include perforations and/or louvers. The container preferably has a tubular construction. Each one piece baffle configuration is retained in the container. The container is terminated with end caps on each end thereof. At least one inlet opening is formed through a perimeter of the container to receive at least one inlet tube. At least one outlet opening is formed through a perimeter of the container substantially opposite the at least one inlet opening. The at least one outlet opening is sized to receive at least one outlet tube.

A second embodiment of the muffler with baffle includes a combination baffle-container and two end caps. The baffle of the combination baffle-container includes at least three different configurations: V, Z and W. The construction of the V, Z and W baffles are the same as in the first embodiment. Each baffle configuration includes openings to allow exhaust flow therethrough. The openings include perforations and/or louvers. The shape of the container of the combination baffle-container is preferably tubular. The combination baffle-container is terminated with end caps on each end thereof. At least one inlet opening is formed through a perimeter of the container of the combination baffle-container to receive at least one inlet tube. An outlet opening is formed through a perimeter of the container of the combination baffle-container substantially opposite the at least one inlet opening. The outlet opening is sized to receive an outlet tube.

A third embodiment of the muffler with baffle includes a a one piece baffle, a container, two end caps, at least one inlet tube and at least one outlet tube. The one piece baffle includes at least three different configurations: V, Z and W. The V, Z and W baffles have the same construction as in the first embodiment of the muffler with baffle. Each baffle configuration includes openings to allow exhaust flow therethrough. The openings include perforations and/or louvers.

The at least one inlet tube passes through a perimeter of the container and through each leg of the one piece baffle to a rear thereof. The outlet tube passes through a perimeter of the container substantially opposite the at least one inlet tube and through each leg of the one piece baffle to a front thereof. The container preferably has a tubular construction. Each one piece baffle configuration is retained in the container. The container is terminated with a single end cap on each end thereof.

A fourth embodiment of the muffler with baffle includes a one piece baffle, a container, two end caps, at least one inlet tube, at least one outlet tube and at least one baffle tube. The one piece baffle includes at least two different configurations: Z and W. The Z and W baffles have the same construction as in the first embodiment of the muffler with baffle. The at least one inlet tube passes through a perimeter of the container and through at least two legs of the one piece baffle. The outlet tube passes through a perimeter of the container substantially opposite the at least one inlet tube and through each leg of the one piece baffle to a front thereof.

At least one resonator tube is inserted through and attached to a first leg of the one piece baffle. At least one baffle tube is inserted through and attached to at least the first and second legs of the one piece baffle. At least one opening is formed through the last leg of the one piece baffle. Each one piece baffle configuration is retained in the container. The container is terminated with a single end cap on each end thereof.

A fifth embodiment of the muffler with baffle includes a a one piece baffle, at least two partitions, a container, two end caps, at least two inlet tubes, at least one outlet tube and at least three balance tubes. The one piece baffle includes at least three different configurations: V, Z and W. The V, Z and W baffles have same construction as in the first embodiment of the muffler with baffle.

A first chamber is formed adjacent a first inlet tube with a first partition extending from a first leg of the one piece baffle. A second chamber is formed adjacent a second inlet tube with a second partition extending from the first leg of the one piece baffle. A middle chamber is formed between the first and second partitions. A first balance tube connects the first chamber to the middle chamber. A second balance tube connects the second chamber to the middle chamber. A third balance tube connects the first chamber to the second chamber. Each baffle configuration includes openings to allow exhaust flow therethrough. The openings include perforations and/or louvers. Each one piece baffle configuration is retained in the container. The container is terminated with a single end cap on each end thereof.

A sixth embodiment of the muffler with baffle includes a one piece corrugated baffle, a container, two end caps, at least one inlet tube, and at least one outlet tube. Each baffle leg includes openings to allow exhaust flow therethrough. The openings include perforations and/or louvers. The one piece corrugated baffle is retained in the container. The container is terminated with a single end cap on each end thereof. The container preferably has a tubular construction. At least one inlet opening is formed through a perimeter of the container to receive the at least one inlet tube. At least one outlet opening is formed through a perimeter of the container substantially opposite the at least one inlet opening. The at least one outlet opening is sized to receive at least one outlet tube.

Accordingly, it is an object of the present invention to provide a muffler with baffle, which includes reduced assembly complexity.

Finally, it is another object of the present invention to provide a muffler with baffle, which includes quieter performance than that of the prior art.

These and additional objects, advantages, features and benefits of the present invention will become apparent from the following specification.

BRIEF DESCRIPTION OF THE DRAWINGS

FIG. 3 is a cut-away top view of a muffler with a V-shaped baffle illustrating the exhaust flow path in accordance with the present invention.

FIG. 5 is a cross sectional view of a muffler with a Z-shaped baffle in accordance with the present invention.

FIG. 8 is a cross sectional view of a muffler with a W-shaped baffle in accordance with the present invention.

FIG. 31 is a perspective view of a fifth embodiment of a muffler with a rectangular shaped container in accordance with the present invention.

FIG. 32 is a perspective view of a fifth embodiment of a muffler with a rectangular shaped container and a cutaway through the container revealing at least three balanced tubes in accordance with the present invention.

DETAILED DESCRIPTION OF THE PREFERRED EMBODIMENTS

Figures 1, 2:
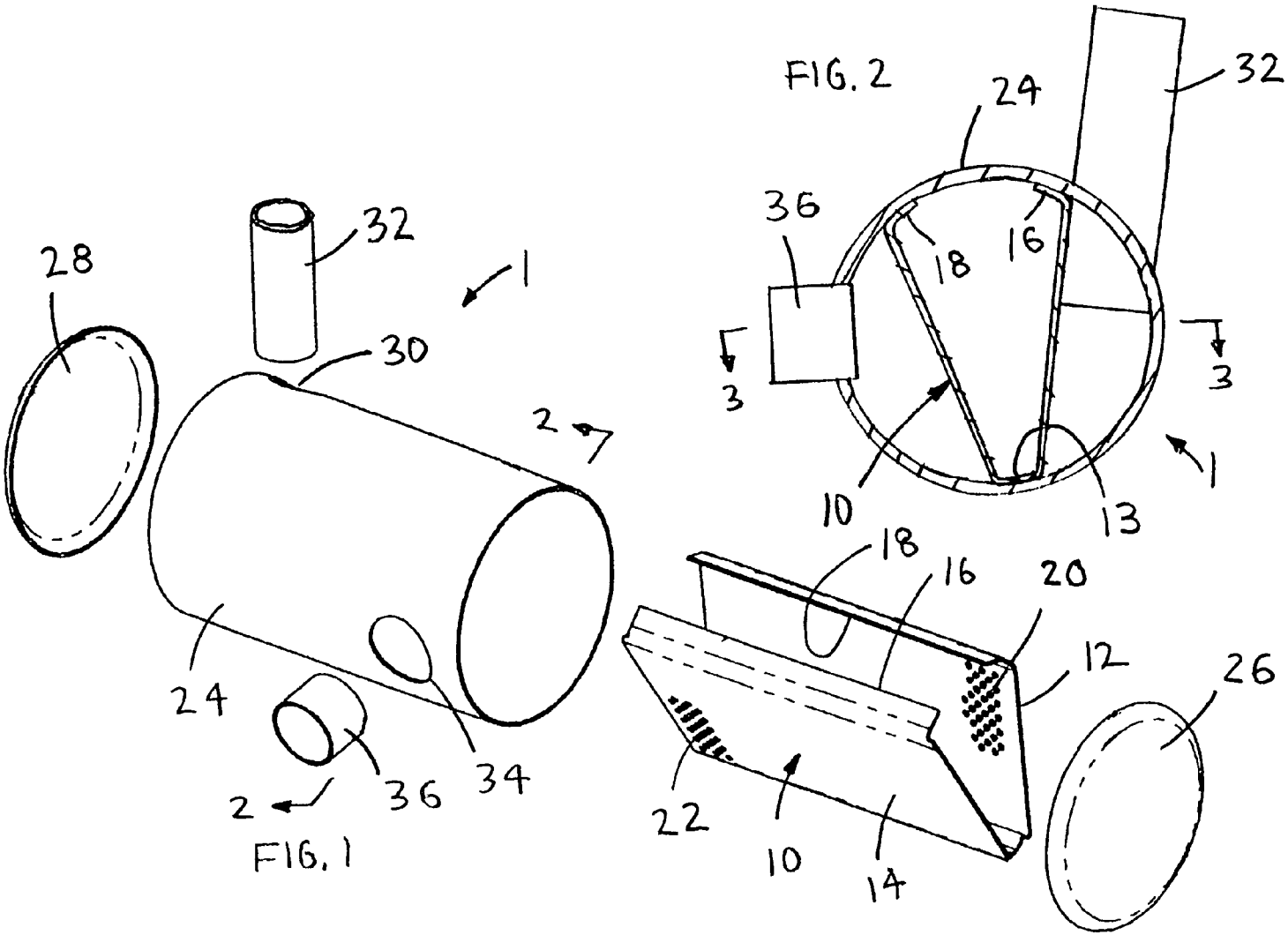
FIG. 1 is an exploded perspective view of a muffler with a V-shaped baffle in accordance with the present invention.
FIG. 2 is a cross sectional view of a muffler with a V-shaped baffle in accordance with the present invention.

With reference now to the drawings, and particularly to FIG. 1, there is shown a perspective view of a muffler with baffle 1. With reference to FIG. 2, the muffler with baffle 1 includes a one piece baffle, a container and two end caps. The one piece baffle includes at least three different configurations: V, Z and W. The V-baffle 10 includes a single plate bent into a first leg 12 and a second leg 14 at an acute angle to each other. A web area 13 preferably joins one end of the first leg 12 to one end of the second leg 14. The other end of the first leg 12 is preferably terminated with a first welding tab 16 and the second leg 14 is preferably terminated with a second welding tab 18. At least one first exhaust opening 20 is formed through the first leg 12 on one end of the V-baffle 10 and at least one second exhaust opening 22 is formed through the second leg 14 on the other end of the V-baffle 10.

The V-baffle 10 is inserted into a container 24 and preferably welded thereto. The cross-section of the container 24 is disclosed as being round in shape, but could be any other appropriate shape, such as oval. A first end cap 26 is attached to one end of the container, preferably with welding, but other attachment methods may also be used. A second end cap 28 is attached to the other end of the container 24. At least one inlet opening 30 is formed through a perimeter of the container 24 to receive at least one inlet tube 32. The at least one inlet tube 32 is preferably attached to the container with welding. An outlet opening 34 is formed through a perimeter of the container 24, substantially opposite the at least one inlet opening to receive an outlet tube 36. The outlet tube 36 is preferably attached to the container with welding.

With reference to FIG. 3, exhaust gases flow into the at least one inlet tube 32, along the outer surface of the first leg 12, through the at least one first exhaust opening 20 and into an area between the inside surfaces of the first and second legs. The exhaust gas continues to flow through the at least one second exhaust opening 22, along the outer surface of the second leg 12 and through the outlet tube 36.

Figure 4:
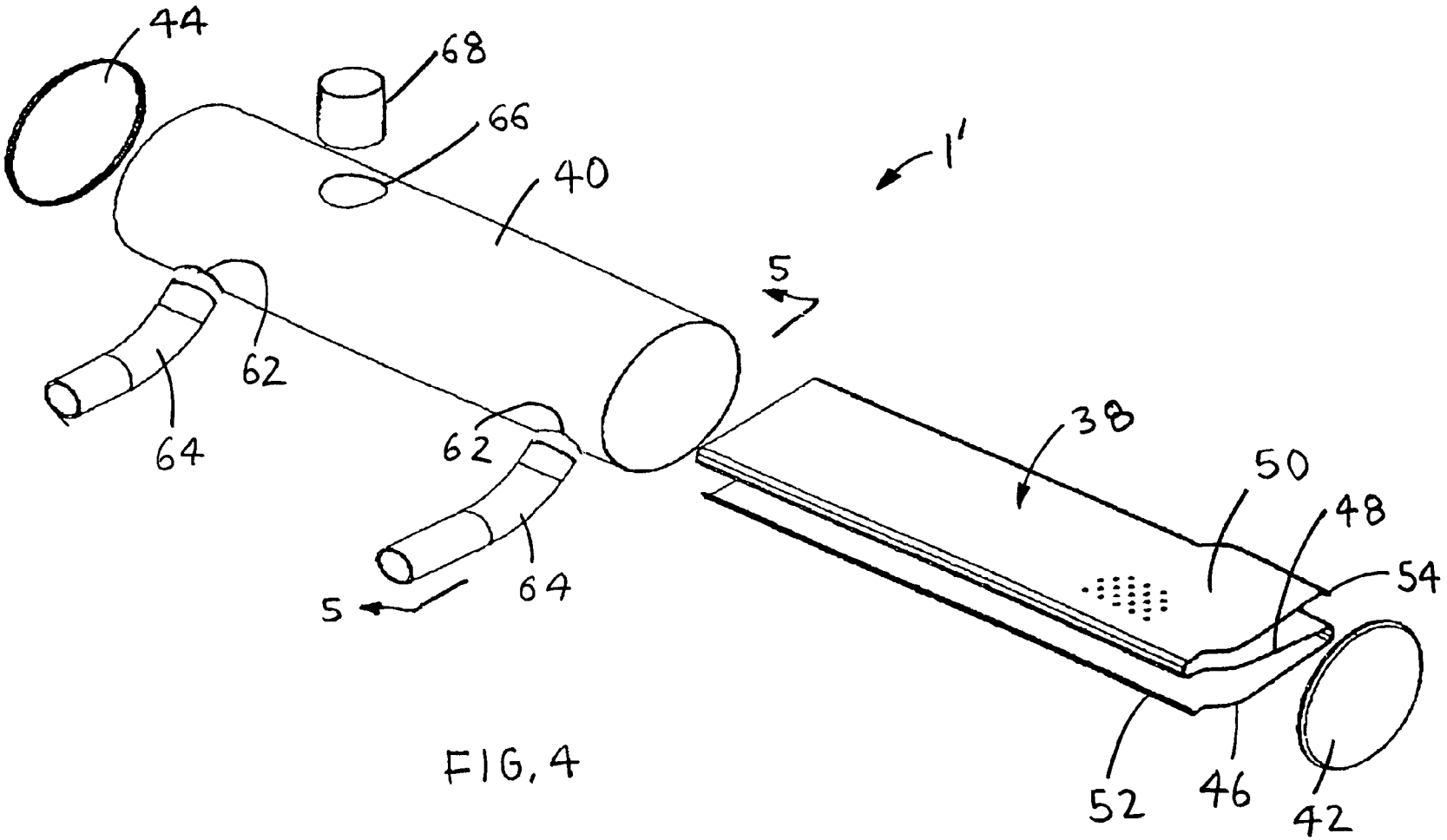
FIG. 4 is an exploded perspective view of a muffler with a Z-shaped baffle in accordance with the present invention.
Figure 6:
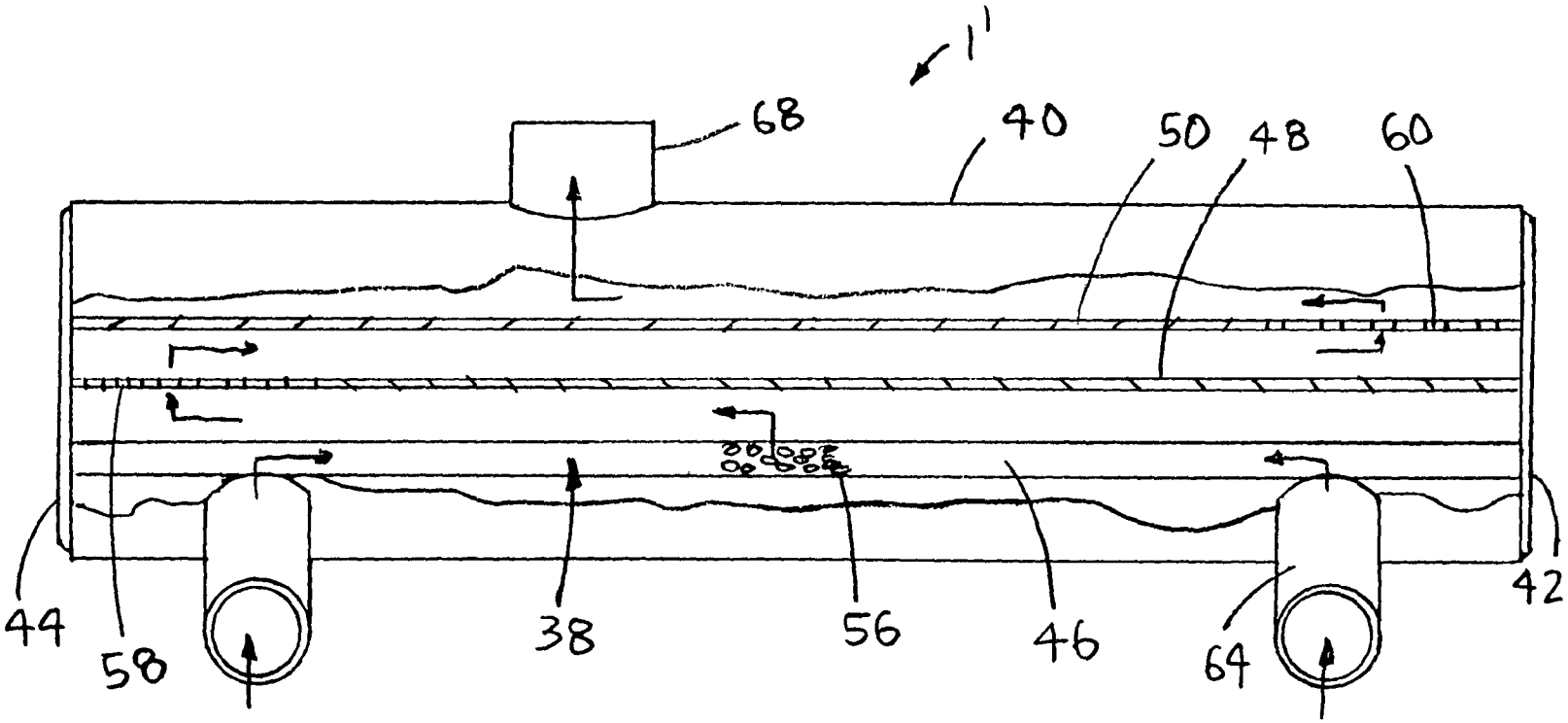
FIG. 6 is a cut-away top view of a muffler with a Z-shaped baffle illustrating the exhaust flow path in accordance with the present invention.

With reference to FIGS. 4–6, a muffler with baffle 1' includes a Z-baffle 38, a container 40, a first end cap 42 and a second end cap 44. The Z-baffle 38 includes a single plate bent into a first leg 46, a second leg 48 and a third leg 50. A first web area 47 preferably joins one end of the first leg 46 to one end of the second leg 48. A second web area 49 preferably joins the other end of the second leg 48 to one end of the third leg 50. Adjacent legs are at an acute angle to each other. The other end of the first leg 46 is preferably terminated with a first welding tab 52 and the other end of the third leg 50 is preferably terminated with a second welding tab 54. At least one first exhaust opening 56 is formed through the first leg 46 in substantially a middle of the Z-baffle 38. At least one second exhaust opening 58 is formed through the second leg 48 on one of the Z-baffle 38. At least one third exhaust opening 60 is formed through the third leg 50 on the other end of the Z-baffle 38.

The Z-baffle 38 is inserted into the container 40 and preferably welded thereto. The cross-section of the container 40 is disclosed as being round in shape, but could be any other appropriate shape, such as oval. A first end cap 42 is attached to one end of the container 40, preferably with welding, but other attachment methods may also be used. A second end cap 44 is attached to the other end of the container 40. At least one inlet opening 62 is formed through a perimeter of the container 40 to receive at least one inlet tube 64. The at least one inlet tube 64 is preferably attached to the container with welding. An outlet opening 66 is formed through a perimeter of the container 40, substantially opposite the at least one inlet opening 62 to receive an outlet tube 68. The outlet tube 68 is preferably attached to the container with welding.

With reference to FIG. 6, exhaust gases flow into the at least one inlet tube 64, along the outer surface of the first leg 46, through the at least one first exhaust opening 56 and into an area between the inside surfaces of the first and second legs. The exhaust gas continues to flow through the at least one second exhaust opening 58, into an area between the inside surfaces of the second and third legs and through the at least one third exhaust opening 60. The exhaust gas continues to flow along the outer surface of the third leg 50 and through the outlet tube 68.

Figure 7:
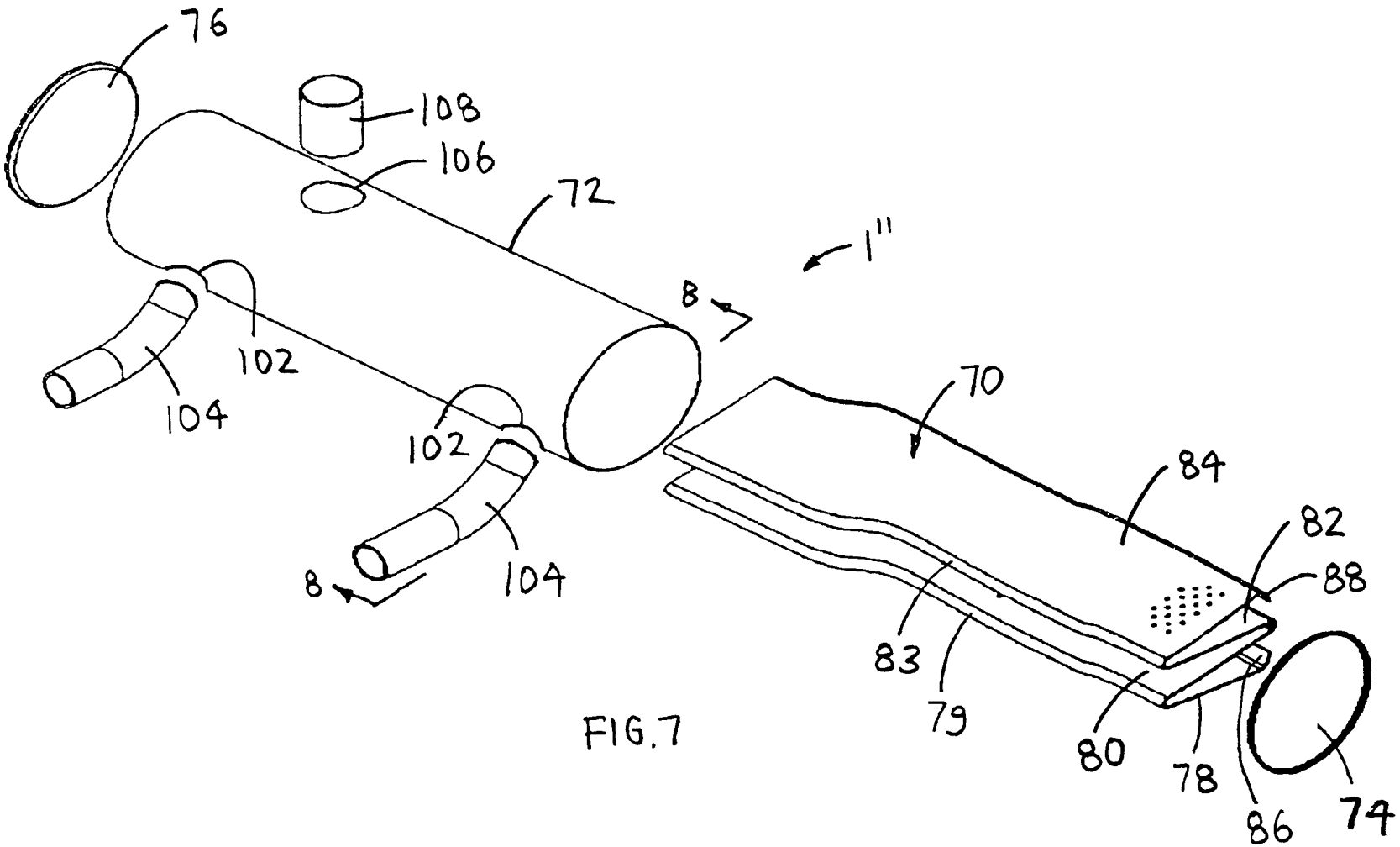
FIG. 7 is an exploded perspective view of a muffler with a W-shaped baffle in accordance with the present invention.
Figure 9:
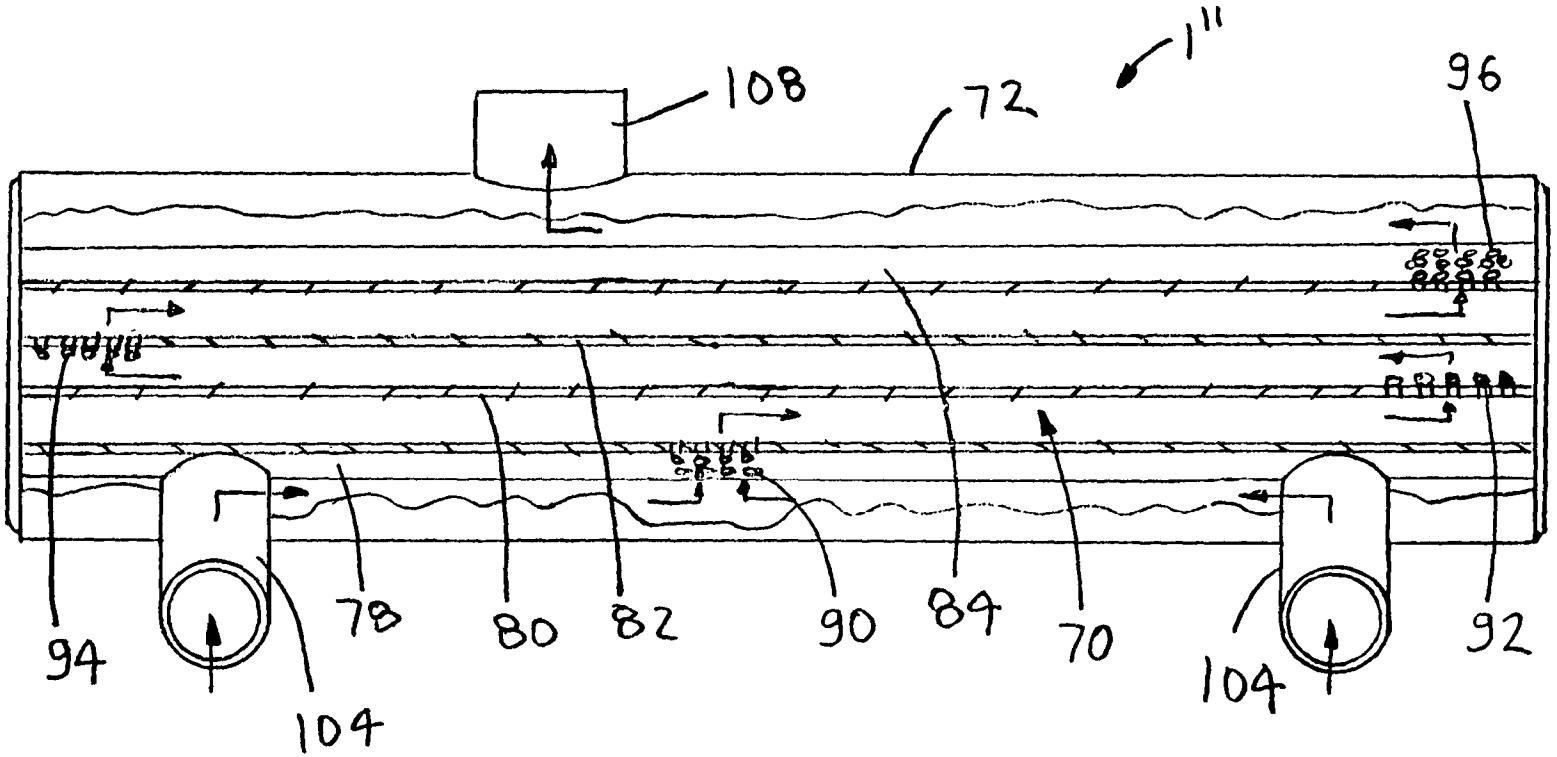
FIG. 9 is a cut-away top view of a muffler with a W-shaped baffle illustrating the exhaust flow path in accordance with the present invention.

With reference to FIGS. 7–9, a muffler with baffle 1" includes a W-baffle 70, a container 72, a first end cap 74 and a second end cap 76. The W-baffle 70 includes a single plate bent into a first leg 78, a second leg 80, a third leg 82 and a fourth leg 84. Adjacent legs are at an acute angle to each other. A first web area 79 preferably joins one end of the first leg 78 to one end of the second leg 80. A second web area 81 preferably joins the other end of the second leg 80 to one end of the third leg 82. A third web area 83 preferably joins the other end of the third leg 82 to one end of the fourth leg 84. The other end of the first leg 78 is preferably terminated with a first welding tab 86 and the other end of the fourth leg 84 is preferably terminated with a second welding tab 88. At least one first exhaust opening 90 is formed through the first leg 78 in substantially a middle of the W-baffle 38. At least one second exhaust opening 92 is formed through the second leg 80 on one of the W-baffle 70. At least one third exhaust opening 94 is formed through the third leg 82 on the other end of the W-baffle 70. At least one fourth exhaust opening 96 is formed through the fourth leg 84 on the one end of the W-baffle 70.

The W-baffle 70 is inserted into the container 72 and preferably welded thereto. The cross-section of the container 72 is disclosed as being round in shape, but could be any other appropriate shape, such as oval. The first end cap 74 is attached to one end of the container 72, preferably with welding, but other attachment methods may also be used. A second end cap 76 is attached to the other end of the container 72. At least one inlet opening 102 is formed through a perimeter of the container 72 to receive at least one inlet tube 104. The at least one inlet tube 104 is preferably attached to the container 72 with welding. At least one outlet opening 106 is formed through a perimeter of the container 72, substantially opposite the at least one inlet opening 102 to receive at least one outlet tube 108. The outlet tube 108 is preferably attached to the container 72 with welding.

With reference to FIG. 9, exhaust gases flow into the at least one inlet tube 104, along the outer surface of the first leg 78, through the at least one first exhaust opening 90 and into an area between the inside surfaces of the first and second legs. The exhaust gas continues to flow through the at least one second exhaust opening 92, into an area between the inside surfaces of the second and third legs and through the at least one third exhaust opening 94. The exhaust gas continues to flow in an area between the third and fourth legs, through the at least one fourth exhaust opening 96, along the outer surface of the fourth leg 84 and through the outlet tube 108.

Other attachment methods may be used besides those disclosed for V, Z & W baffle mufflers. Locations of exhaust openings should not be limited to that shown in FIGS. 1–9, but should include any other suitable location(s). The exhaust openings shown in FIGS. 1–9 are preferably perforations, but could be any other suitable opening. One example of other locations and other exhaust openings is disclosed in FIGS. 10–13.

Figure 10:
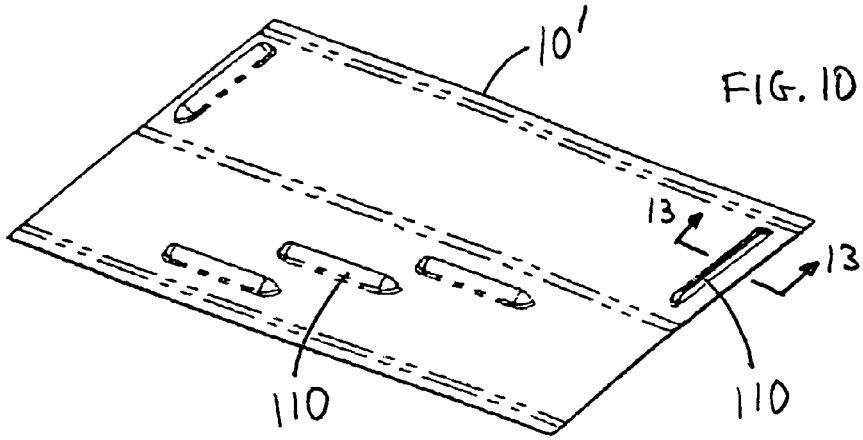
FIG. 10 is a perspective view of an unbent V-shaped baffle with a plurality of louvers parallel with the edges thereof in accordance with the present invention.
Figure 11:
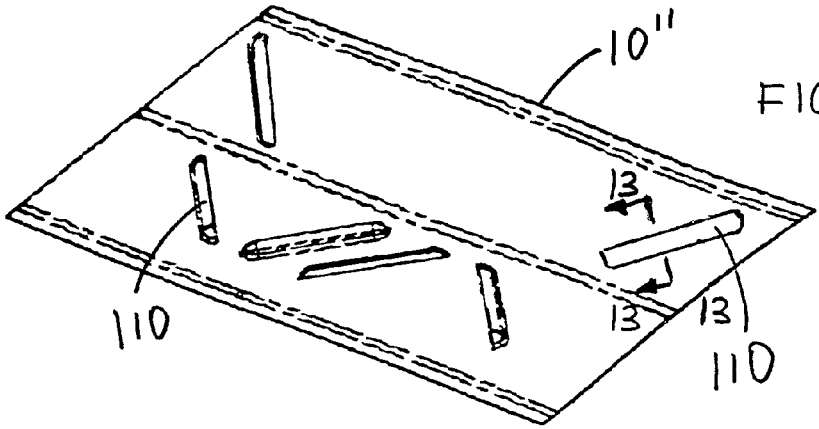
FIG. 11 is a perspective view of an unbent V-shaped baffle with a plurality of louvers not parallel with the edges thereof in accordance with the present invention.
Figure 13:
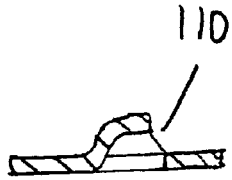
FIG. 13 is a cross sectional view of a louver of a muffler with a V-shaped baffle in accordance with the present invention.
Figure 12:
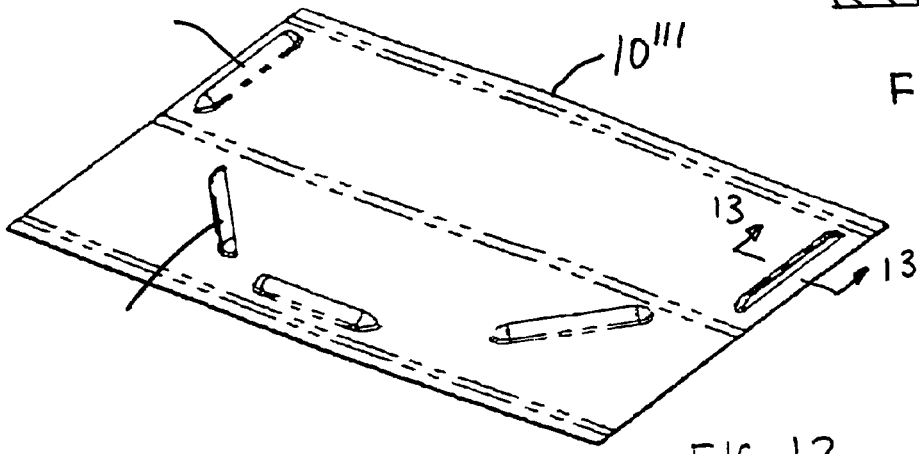
FIG. 12 is a perspective view of an unbent V-shaped baffle with a plurality of louvers parallel and not parallel with the edges thereof in accordance with the present invention.

With reference to FIG. 10, a plurality of louver openings 110 are arranged in V-baffle 10', such that each louver opening 110 is substantially parallel to the perimeter of the V-baffle 10'. A cross section of a louver opening 110 is shown in FIG. 13. With reference to FIG. 11, the plurality of louver openings 110 are arranged in a V-baffle 10", such that each louver opening 110 is nonparallel to the perimeter of the V-baffle 10". With reference to FIG. 12, the plurality of louver openings 110 are arranged in a V-baffle 10''', such that some louver openings 110 are nonparallel and substantially parallel to the perimeter of the V-baffle 10'''.

Figures 14, 15, 16:
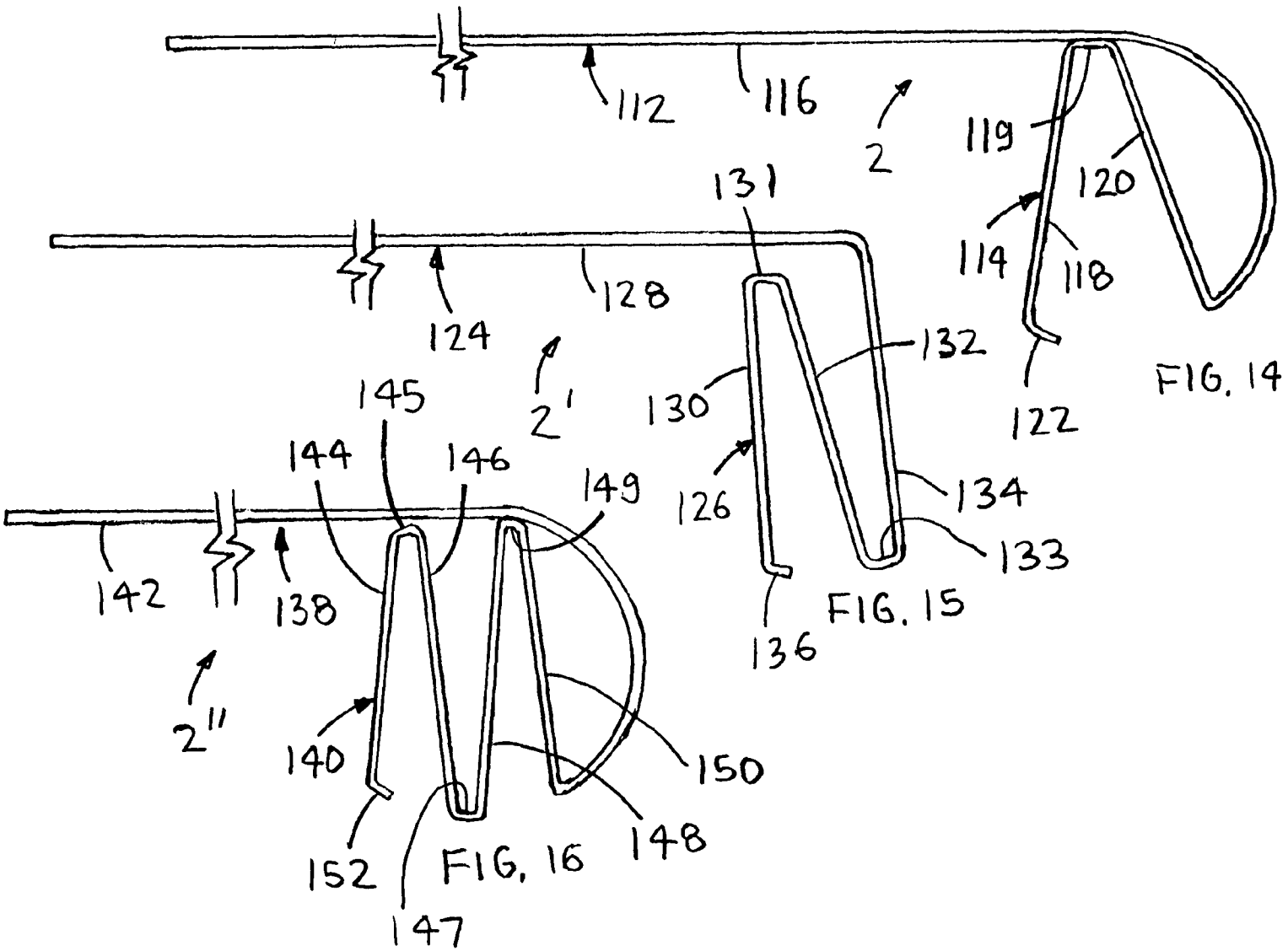
FIG. 14 is an end view of a second embodiment of a muffler with a V-shaped baffle, which is partially bent to its final shape in accordance with the present invention.
FIG. 15 is an end view of a second embodiment of a muffler with a Z-shaped baffle, which is partially bent to its final shape in accordance with the present invention.
FIG. 16 is an end view of a second embodiment of a muffler with a W-shaped baffle, which is partially bent to its final shape in accordance with the present invention.

With reference to FIGS. 14–16, a second embodiment of the muffler with baffle 2 includes a combination baffle-container and two end caps. The baffle of the combination baffle-container includes at least three different configurations: V, Z and W. The construction of the V, Z and W baffles are similar to the first embodiment. A muffler with baffle 2 includes a combination V-baffle-container 112 and two end caps (not shown). The combination V-baffle-container 112 includes a V-baffle portion 114 and a container portion 116. The V-baffle portion 114 includes a first leg 118 and a second 120. A web area 119 preferably joins one end of the first leg 118 to one end of the second leg 120. A welding tab 122 extends from the other end of the first leg 114.

At least one first exhaust opening is formed in the first leg 118 and at least one second exhaust opening is formed through the second leg 120. One end of the container portion 116 extends from the other end of the second leg 120. At least one inlet opening and an outlet opening is formed in a perimeter of the container portion to receive at least one inlet tube and at least one outlet tube, respectively. The container portion 116 is preferably wrapped around the V-baffle portion 114 to form a container, similar to the container 24. The other end of the container portion 116 is attached to itself with welding or any other suitable attachment process. A single end cap is attached to each end of the formed combination V-baffle-container 112 preferably with welding or any other suitable attachment process. The muffler with baffle 2 is similar to the muffler with baffle 1, except that the V-baffle and the container of the muffler with baffle 2 are fabricated from a single piece of material.

A muffler with baffle 2' includes a combination Z-baffle-container 124 and two end caps (not shown). The combination Z-baffle-container 124 includes a Z-baffle portion 126 and a container portion 128. The Z-baffle portion 126 includes a first leg 130, a second leg 132 and a third leg 134. A first web area 131 preferably joins one end of the first leg 128 to one end of the second leg 130. A second web area 133 preferably joins the other end of the second leg 132 to one end of the third leg 134. A welding tab 136 extends from the other end of the first leg 130.

At least one first exhaust opening is formed in the first leg 130; at least one second exhaust opening is formed in the second leg 132; and at least one third exhaust opening is formed in the third leg 134. One end of the container portion 128 extends from the other end of the third leg 134. At least one inlet opening and an outlet opening is formed in a perimeter of the container portion to receive at least one inlet tube and at least one outlet tube, respectively.

The container portion 128 is preferably wrapped around the Z-baffle portion 126 to form a container, similar to the container 40. The other end of the container portion 128 is attached to itself with welding or any other suitable attachment process. A single end cap is attached to each end of the formed combination Z-baffle-container 124, preferably with welding or any other suitable attachment process. The muffler with baffle 2' is similar to the muffler with baffle 1', except that the Z-baffle and the container of the muffler with baffle 2' are fabricated from a single piece of material.

A muffler with baffle 2" includes a combination W-baffle-container 138 and two end caps (not shown). The combination W-baffle-container 138 includes a W-baffle portion 140 and a container portion 142. The W-baffle portion 140 includes a first leg 144, a second leg 146, a third leg 148 and a fourth leg 150. A first web area 145 preferably joins one end of the first leg 144 to one end of the second leg 146. A second web area 147 preferably joins the other end of the second leg 146 to one end of the third second leg 148. A third web area 149 preferably joins the other end of the third leg 148 to one end of the fourth leg 150. A welding tab 152 extends from the other end of the first leg 144.

At least one first exhaust opening is formed in the first leg 144; at least one second exhaust opening is formed in the second leg 146; at least one third exhaust opening is formed in the third leg 148; and at least one fourth exhaust opening is formed in the fourth leg 150. One end of the container portion 142 extends from the other end of the fourth leg 150. At least one inlet opening and an outlet opening is formed in a perimeter of the container portion to receive at least one inlet tube and an outlet tube, respectively. The container portion 142 is preferably wrapped around the W-baffle portion 140 to form a container, similar to the container 72. The other end of the container portion 142 is attached to itself with welding or any other suitable attachment process. A single end cap is attached to each end of the formed combination W-baffle-container 138 preferably with welding or any other suitable attachment process. The muffler with baffle 2" is similar to the muffler with baffle 1", except that the W-baffle and the container of the muffler with baffle 2" are fabricated from a single piece of material. More than one outlet tube may be used for each muffler. FIGS. 1–9 should be relied upon for elements not specifically illustrated in FIGS. 14–16.

Figure 17:
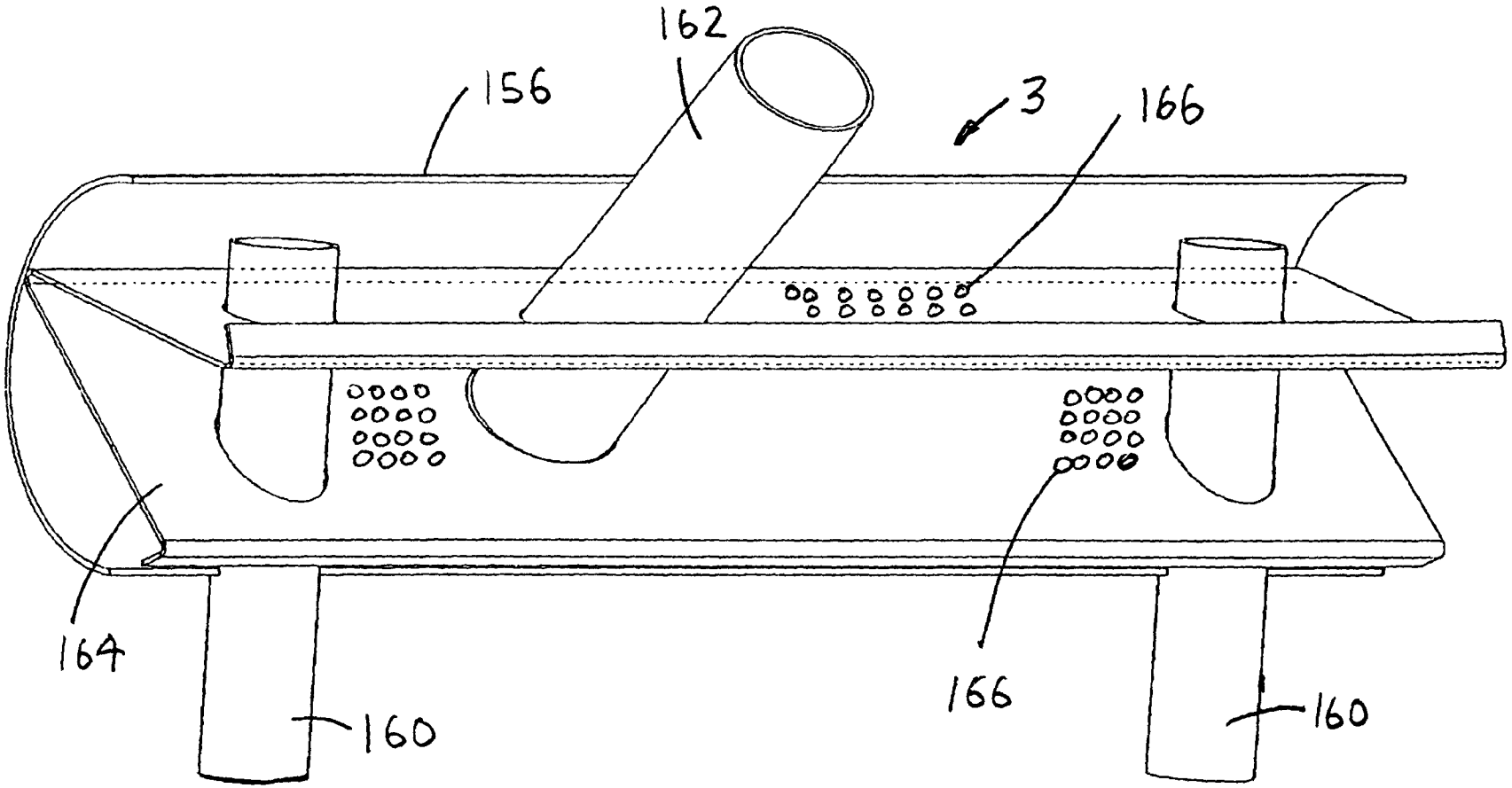
FIG. 17 is a perspective view of a third embodiment of a muffler with a cutaway through the container revealing a V-shaped baffle in accordance with the present invention.
Figure 18:
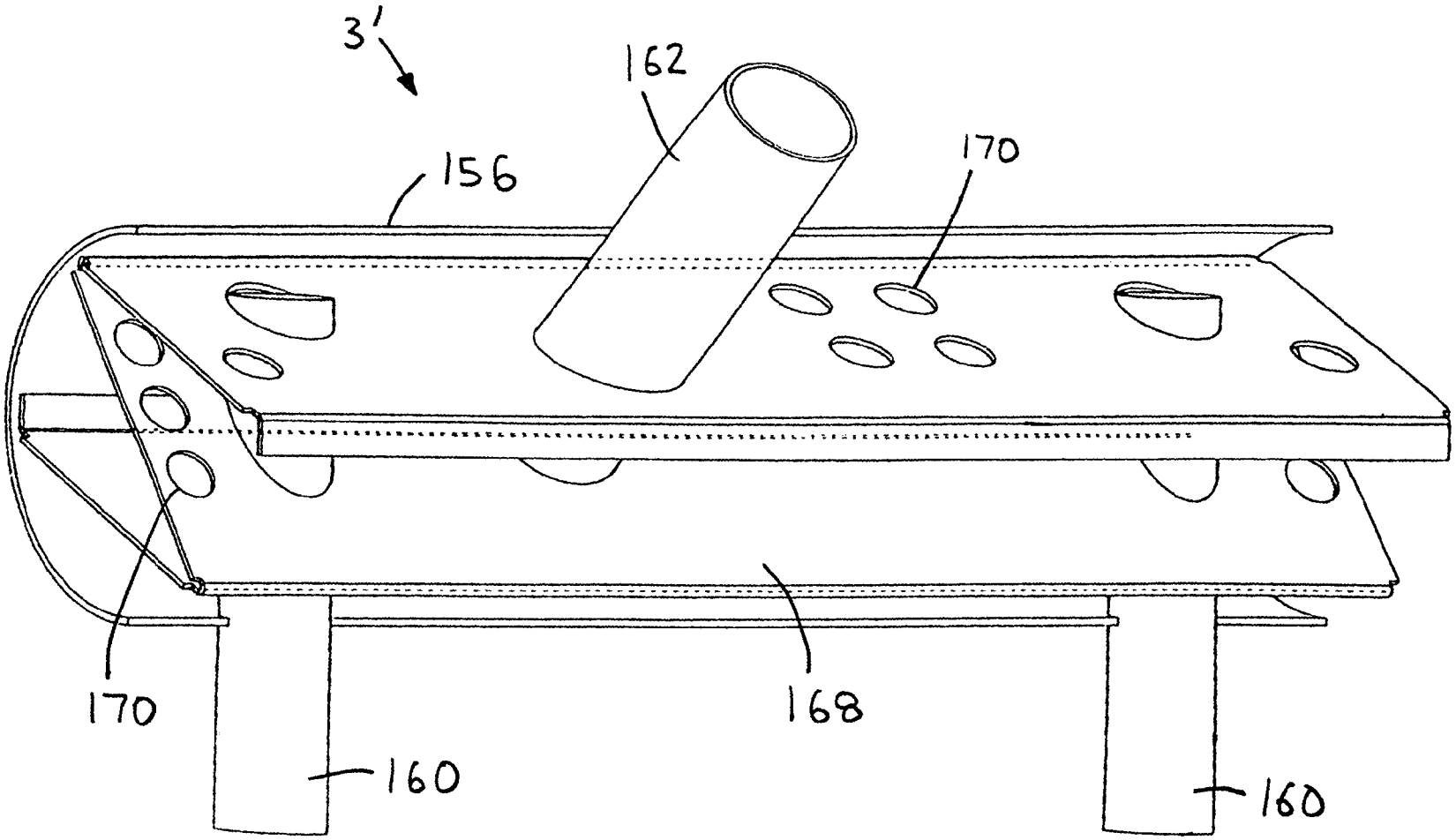
FIG. 18 is a perspective view of a third embodiment of a muffler with a cutaway through the container revealing a Z-shaped baffle in accordance with the present invention.
Figure 19:
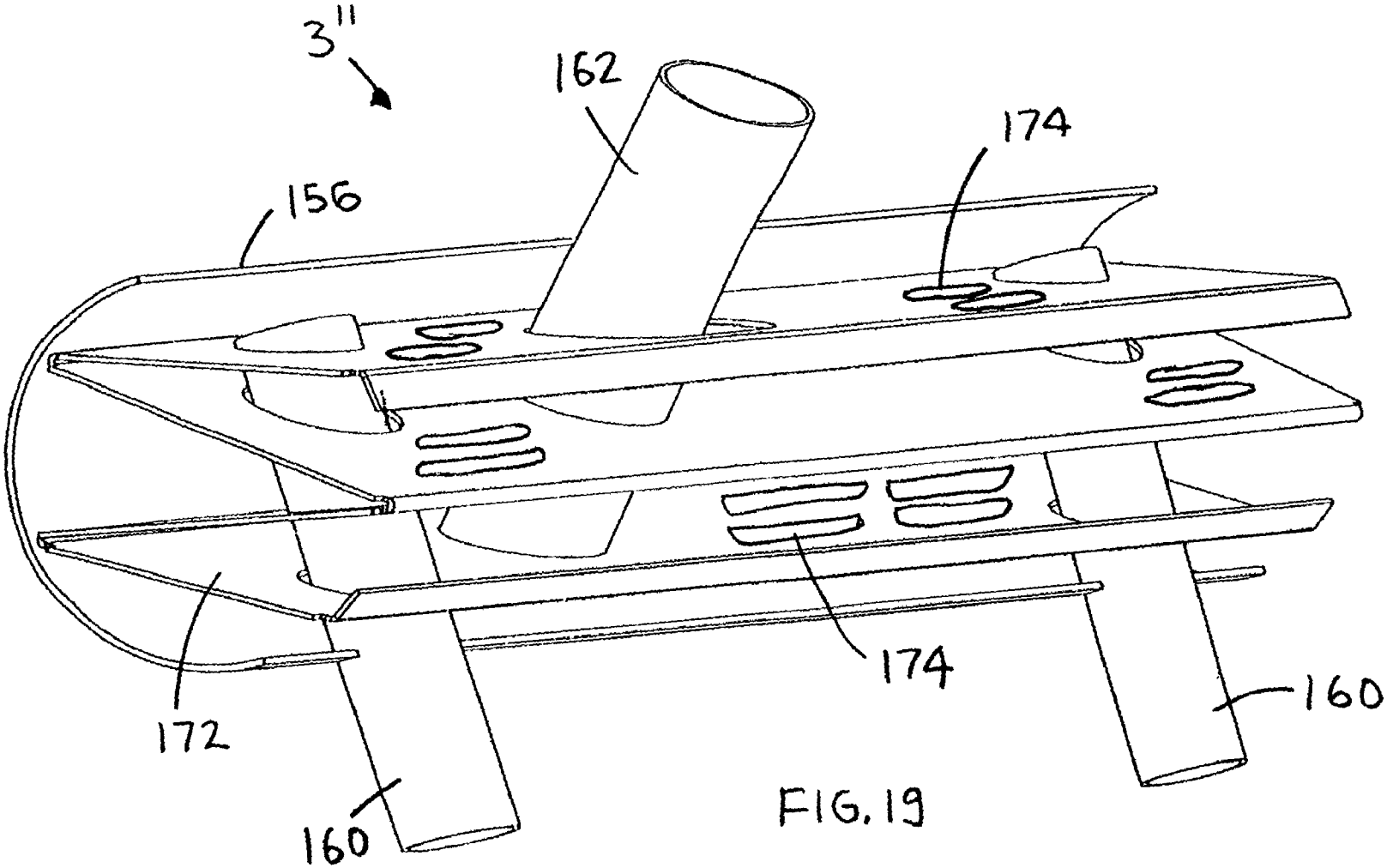
FIG. 19 is a perspective view of a third embodiment of a muffler with a cutaway through the container revealing a W-shaped baffle in accordance with the present invention.
Figure 20:
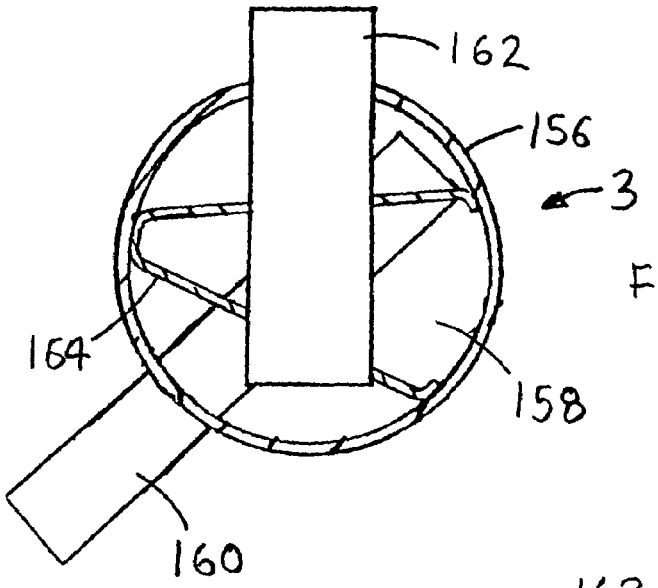
FIG. 20 is an end cross sectional view of a third embodiment of a muffler with a V-shaped baffle in accordance with the present invention.

With reference to FIGS. 17 and 20, a third embodiment of the muffler with baffle 3 includes a one piece baffle, a container 156, two end caps 158, at least one inlet tube 160 and at least one outlet tube 162. The one piece baffle includes at least three different configurations: V, Z and W. The V, Z and W baffles have the same construction as in the first embodiment of the muffler with baffle. Locations of exhaust openings should not be limited to that shown in FIGS. 17–19, but should include any other suitable location(s). The exhaust openings shown in FIGS. 17–19 are preferably perforations, but could be any other suitable opening. One example of other locations and other exhaust openings is disclosed in FIGS. 10–13.

The muffler with baffle 3 includes a V-baffle 164. The at least one inlet tube 160 passes through a perimeter of the container 156 and through each leg of the V-baffle 164 to a rear thereof. The at least one outlet tube 162 passes through a perimeter of the container, substantially opposite the at least one inlet tube 160 and through each leg of the V-baffle 164 to a front thereof. The container 156 preferably has a tubular construction. A plurality of perforations 166 are shown formed through each leg of the V-baffle 164, which allow exhaust gases to pass through thereof and out the at least one outlet tube 162. However, other suitable openings may also be used, as previously stated.

Figure 21:
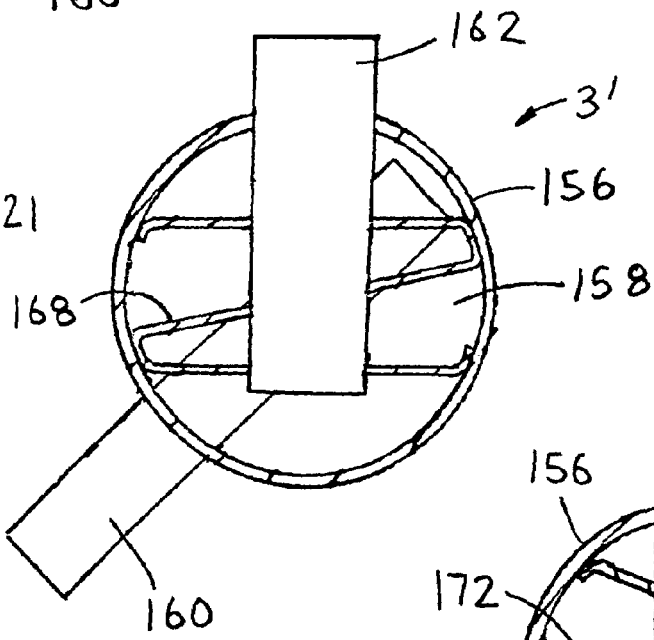
FIG. 21 is a end cross sectional view of a third embodiment of a muffler with a Z-shaped baffle in accordance with the present invention.

With reference to FIGS. 18 and 21, a muffler with baffle 3' includes a Z-baffle 168. The at least one inlet tube 160 passes through a perimeter of the container 156 and through each leg of the Z-baffle 168 to a rear thereof. The at least one outlet tube 162 passes through a perimeter of the container substantially opposite the at least one inlet tube 160 and through each leg of the Z-baffle 168 to a front thereof. The container 156 preferably has a tubular construction. A plurality of openings 170 are shown formed through each leg of the Z-baffle 168, which allow exhaust gases to pass through thereof and out the at least one outlet tube 162. However, other suitable openings may also be used, as previously stated.

Figure 22:
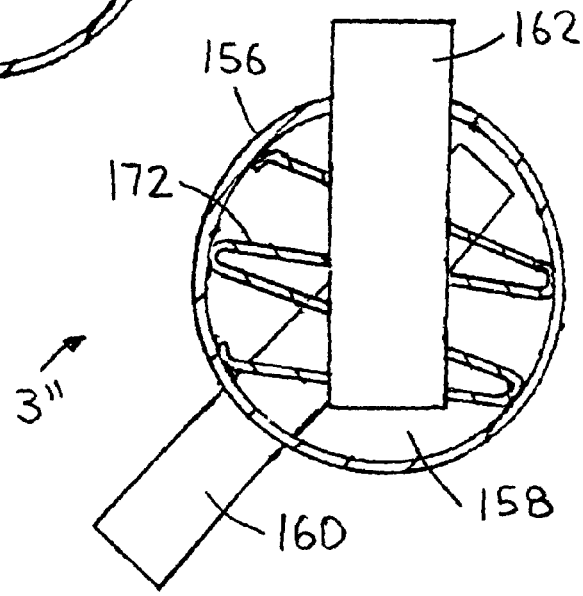
FIG. 22 is a side cross sectional view of a third embodiment of a muffler with a W-shaped baffle in accordance with the present invention.

With reference to FIGS. 19 and 22, a muffler with baffle 3" includes a W-baffle 172. The at least one inlet tube 160 passes through a perimeter of the container 156 and through each leg of the W-baffle 172 to a rear thereof. The at least one outlet tube 162 passes through a perimeter of the container substantially opposite the at least one inlet tube 160 and through each leg of the W-baffle 172 to a front thereof. The container 156 preferably has a tubular construction. A plurality of louvers 174 are shown formed through each leg of the W-baffle 172, which allow exhaust gases to pass through thereof and out the at least one outlet tube 162. However, other suitable openings may also be used, as previously stated. A single end cap 158 terminates each end of the container 156.

Figure 23:
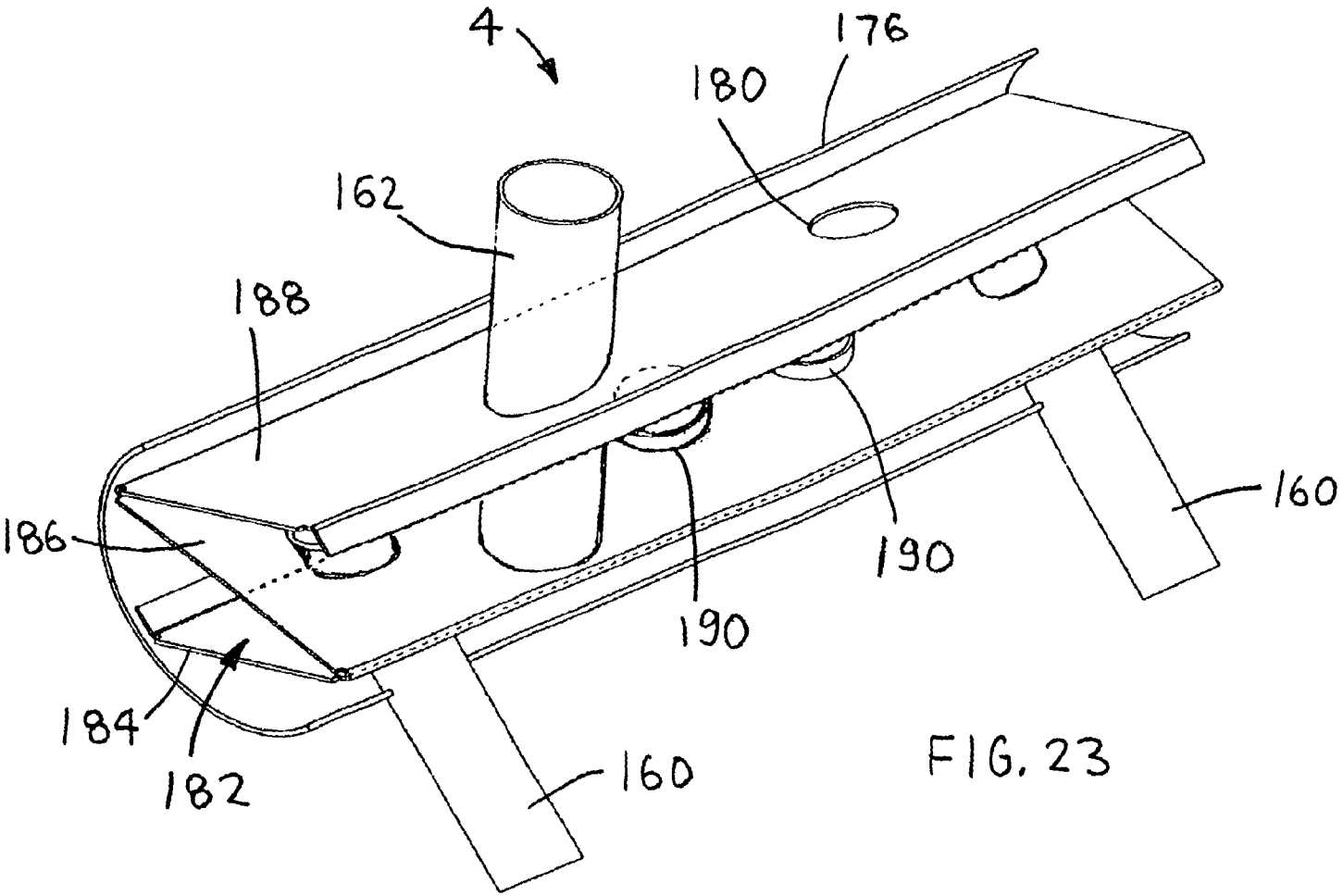
FIG. 23 is a perspective view of a fourth embodiment of a muffler with a cutaway through the container revealing a Z-shaped baffle in accordance with the present invention.
Figure 25:
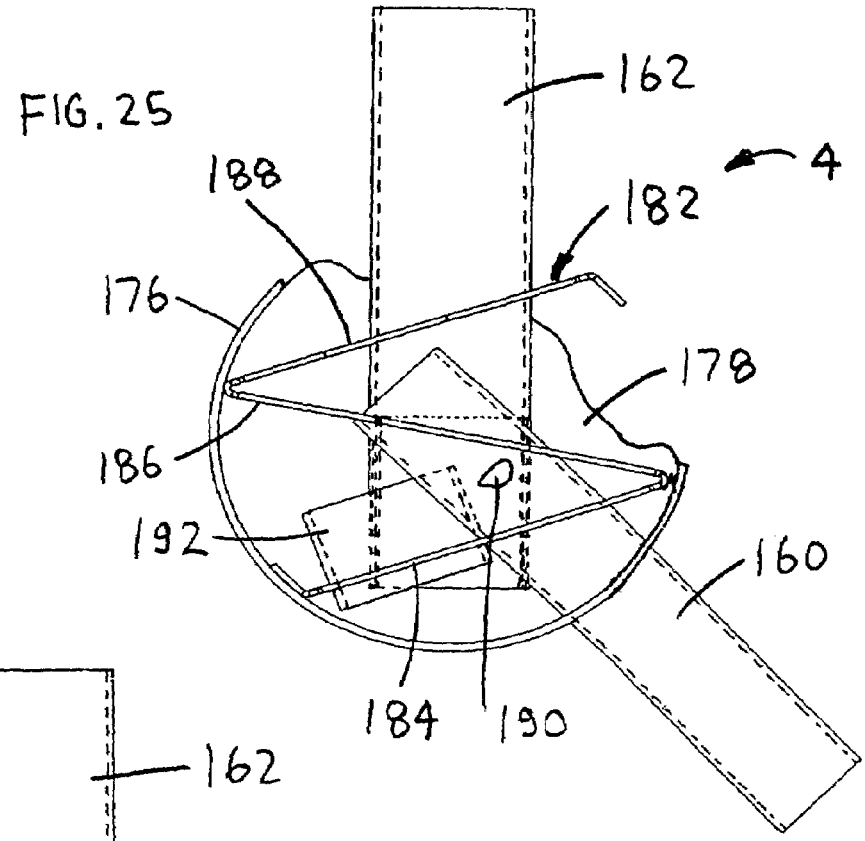
FIG. 25 is an end cross sectional view of a fourth embodiment of a muffler with a Z-shaped baffle in accordance with the present invention.

With reference to FIGS. 23 and 25, a fourth embodiment of the muffler with baffle 4 includes a one piece baffle, a container 176, two end caps 178, at least one inlet tube 160, at least one outlet tube 162 and at least one baffle tube. The one piece baffle includes at least two different configurations: Z and W. The Z and W baffles have the same construction as in the first embodiment of the muffler with baffle.

The muffler with baffle 4 includes a Z-baffle 182. The Z-baffle 182 includes a first Z-leg 184, a second Z-leg 186 and a third Z-leg 188. The at least one inlet tube 160 passes through a perimeter of the container 176 and through the first and second Z-legs to a rear thereof. The at least one outlet tube 162 passes through a perimeter of the container 176, substantially opposite the at least one inlet tube 160 and through each leg of the Z-baffle 182 to a front thereof. The container 176 preferably has a tubular construction. A resonator opening 180 is formed through the third Z-leg 188 to allow the area between the container 176 and the third Z-leg 188 to act as a resonator chamber. At least one baffle tube 190 is inserted through and secured to the first and second Z-legs. The at least one baffle tube 190 allows exhaust from the exit of the at least one inlet tube 160 to pass to an entrance of the at least one outlet tube 162. A resonator tube 192 is inserted through and secured to the first Z-leg 184 to allow the area between the first and second Z-legs to act as a resonator chamber.

Figure 24:
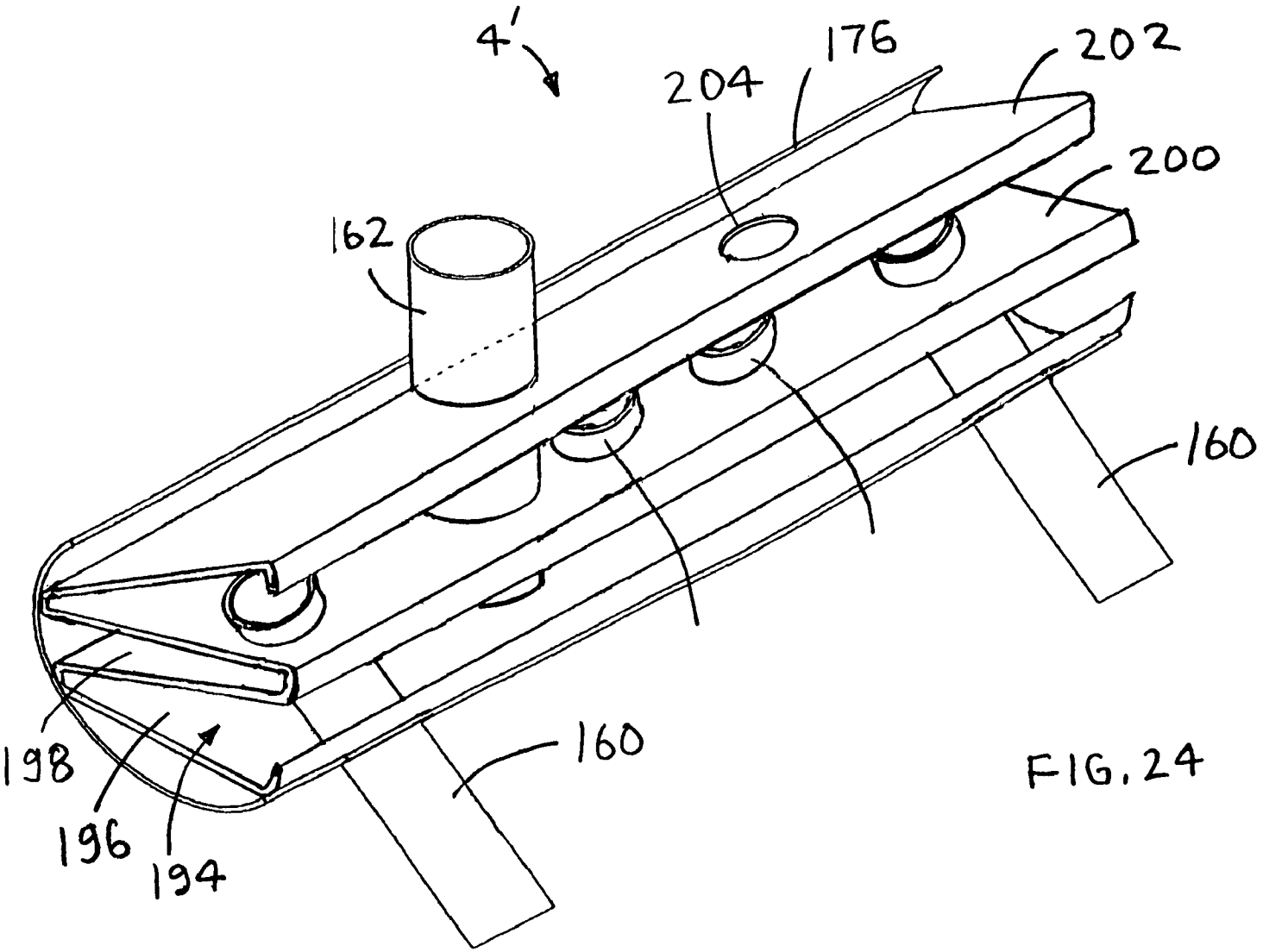
FIG. 24 is a perspective view of a fourth embodiment of a muffler with a cutaway through the container revealing a W-shaped baffle in accordance with the present invention.
Figure 26:
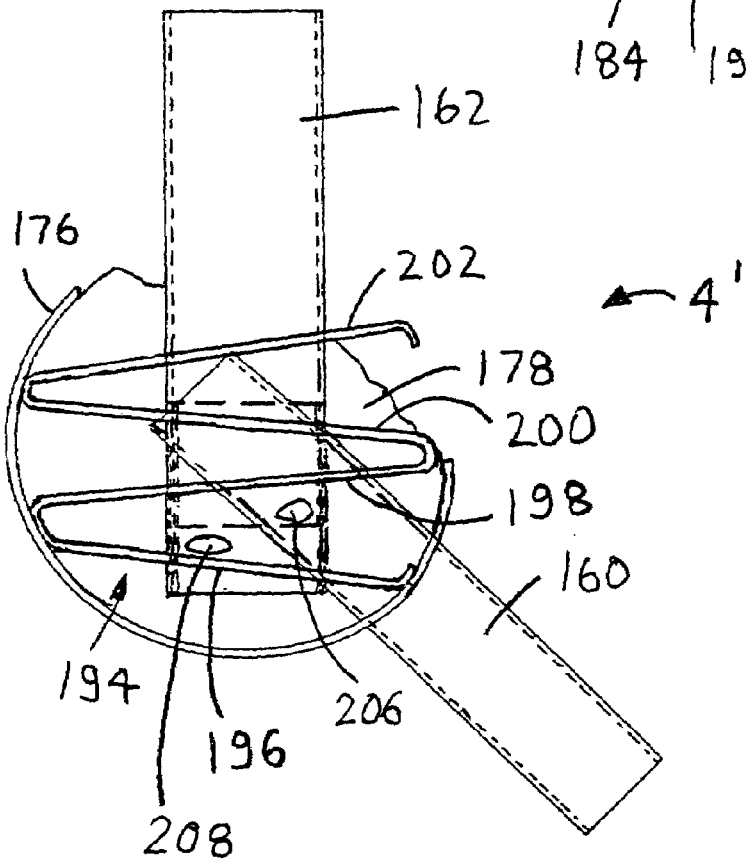
FIG. 26 is an end cross sectional view of a fourth embodiment of a muffler with a W-shaped baffle in accordance with the present invention.

With reference to FIGS. 24 and 26, the muffler with baffle 4' includes a W-baffle 194. The W-baffle 194 includes a first W-leg 196, a second W-leg 198, a third W-leg 200 and a fourth W-leg 202. The at least one inlet tube 160 passes through a perimeter of the container 176 and through the first, second and third legs of the W-baffle 194 to a rear thereof. The at least one outlet tube 162 passes through a perimeter of the container 176, substantially opposite the at least one inlet tube 160 and completely through the W-baffle 194. The container 176 preferably has a tubular construction. A resonator opening 204 is formed through the fourth W-leg 202 to allow the area between the container 176 and the fourth W-leg 202 to act as a resonator chamber. At least one baffle tube 206 is inserted through and secured to the first, second and third W-legs. The at least one baffle tube 206 allows exhaust from the exit of the at least one inlet tube 160 to pass to entrance of the at least one outlet tube 162. A resonator tube 208 is inserted through and secured to the first W-leg 196 to allow the area between the first and second W-legs to act as a resonator chamber. A single end cap 158 terminates each end of the container 156.

Figure 27:
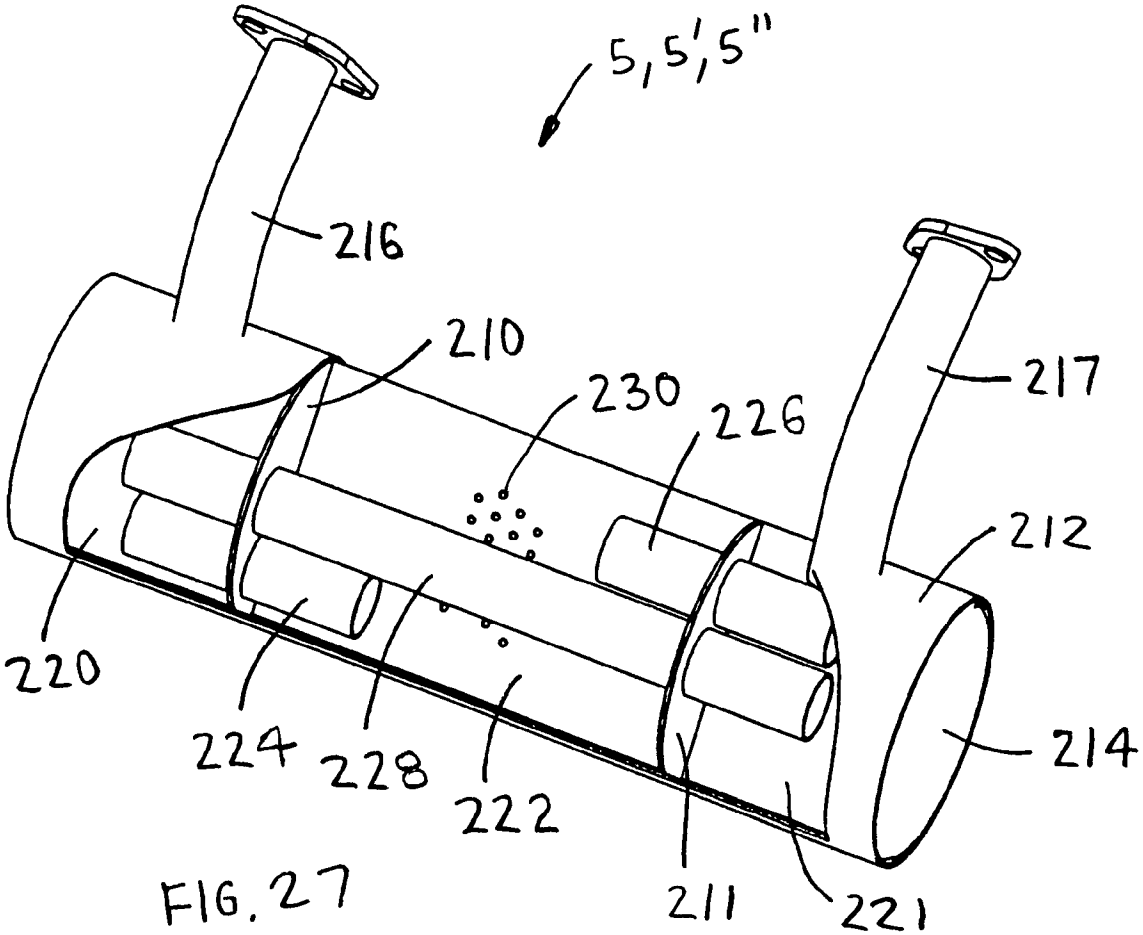
FIG. 27 is a perspective view of a fifth embodiment of a muffler with a cutaway through the container revealing at least three balanced tubes in accordance with the present invention.
Figures 28, 29, 30:
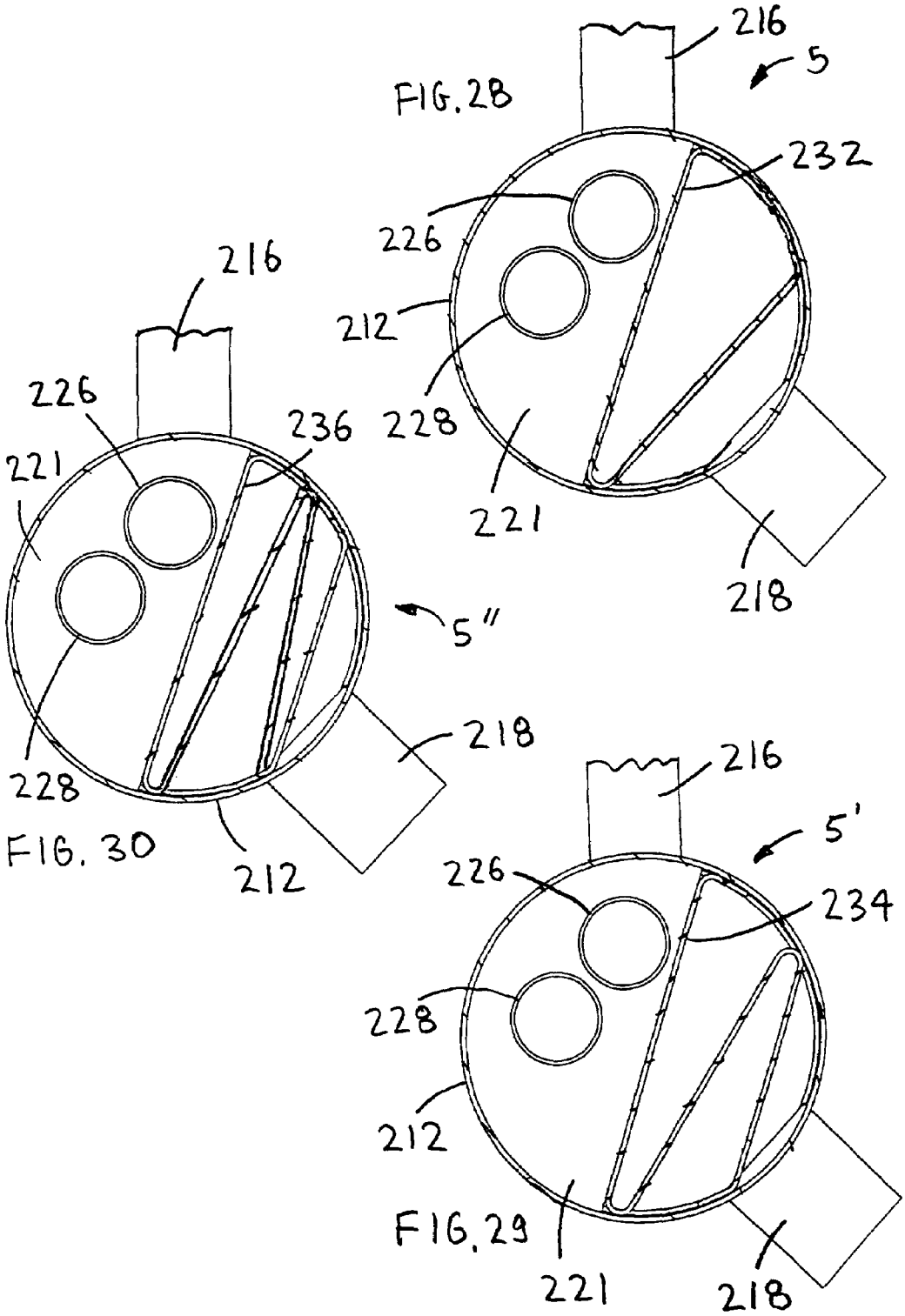
FIG. 28 is an end cross sectional view of a fifth embodiment of a muffler with a V-shaped baffle in accordance with the present invention.
FIG. 29 is an end cross sectional view of a fifth embodiment of a muffler with a Z-shaped baffle in accordance with the present invention.
FIG. 30 is an end cross sectional view of a fifth embodiment of a muffler with a W-shaped baffle in accordance with the present invention.

With reference to FIGS. 27–28, a fifth embodiment of the muffler with baffle 5, 5', 5" includes a one piece baffle, at least two partitions, a container 212, two end caps 214, at least two inlet tubes, at least one outlet tube 218 and at least three balance tubes. The one piece baffle includes at least three different configurations: V, Z and W. The V, Z and W baffles are the same construction as in the first embodiment of the muffler with baffle.

A first chamber 220 is formed in the area bounded by a first partition 210, one of the end caps 214 and the one piece baffle. A second chamber 221 is formed in the area bounded by a second partition 211, the other end cap 214 and the one piece baffle. A middle chamber 222 is formed between the first and second partitions and the one piece baffle. A first balance tube 224 is inserted through and secured to the first partition 210 to connect the first chamber 220 to the middle chamber 222. A second balance tube 224 is inserted through and secured to the second partition 211 to connect the second chamber 221 to the middle chamber 222. A third balance tube 228 is inserted through and secured to the first and second partitions to connect the first and second chambers. The first and second inlet tubes are inserted through and secured to a wall of the container 212. The at least one outlet tube 218 is inserted through and secured to a wall of the container 212, substantially opposite the first and second inlet tubes.

Exhaust from a first inlet tube 216 flows through the first balance tube 224 into the middle chamber 222. The exhaust continues to flow through a plurality of perforations 230 or the like formed through the first leg of the one piece baffle. Exhaust from a second inlet tube 217 flows through the second balance tube 226 into the middle chamber 222. The exhaust continues to flow through a plurality of perforations 230 or the like formed through the each leg of the one piece baffle. Excess back pressure in either the first or second chambers will flow into the second or first chambers, respectively.

With reference to FIG. 28, a V-baffle 232 is retained in an inner perimeter of the container 212. The first and second partitions are attached to a first leg of the V-baffle 232 with any suitable method, such as welding. With reference to FIG. 29, a Z-baffle 234 is retained in an inner perimeter of the container 212. The first and second partitions are attached to a first leg of the Z-baffle 234 with any suitable method, such as welding. With reference to FIG. 30, a W-baffle 236 is retained in an inner perimeter of the container 212. The first and second partitions are attached to a first leg of the W-baffle 236 with any suitable method, such as welding. The container 212 is terminated with a single end cap 214 on each end thereof.

Figure 33A:
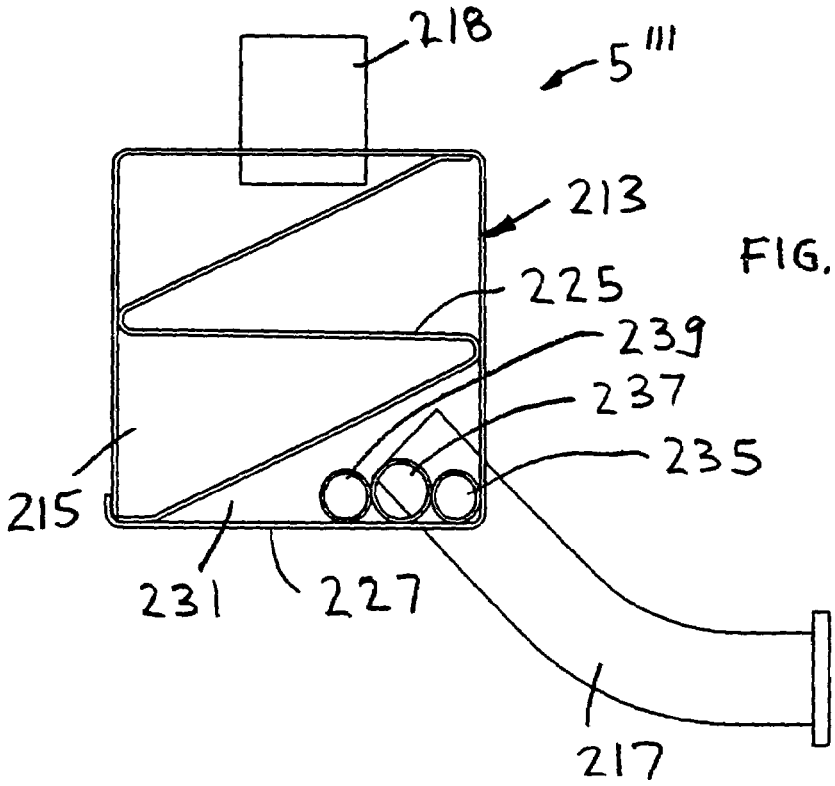
FIG. 33*a* is an end cross sectional view of a fifth embodiment of a muffler with a rectangular shaped container and a Z-shaped baffle in accordance with the present invention.

With reference to FIGS. 31–33*a*, a fifth embodiment of the muffler with baffle 5'" includes a one piece combination baffle-container 213, at least two partitions, two end caps 215, the at least two inlet tubes, at least one outlet tube 218 and at least three balance tubes. A baffle with a "Z" configuration is shown in FIG. 33*a*, but other configurations such as "V" or "W" may also be used. The one piece combination baffle-container 213 includes a baffle portion 225 and a container portion 227.

A first chamber 223 is formed in the area bounded by a first partition 219, one of the end caps 215 and the baffle portion 225, 243. A second chamber 229 is formed in the area bounded by a second partition 231, the other end cap 215 and the baffle portion 225, 243. A middle chamber 233 is formed between the first and second partitions and the baffle portion 225, 243. A first balance tube 235 is inserted through and secured to the first partition 219 to connect the first chamber 223 to the middle chamber 233. A second balance tube 239 is inserted through and secured to the second partition 231 to connect the second chamber 229 to the middle chamber 233. A third balance tube 237 is inserted through and secured to the first and second partitions to connect the first and second chambers. The first and second inlet tubes are inserted through and secured to a wall of the container portion 227, 245. The at least one outlet tube 218 is inserted through and secured to a wall of the container portion 227, substantially opposite the first and second inlet tubes.

Exhaust from a first inlet tube 216 flows through the first balance tube 235 into the middle chamber 233. The exhaust continues to flow through a plurality of perforations 241 or the like formed through the first leg of the baffle portion 225, 243. Exhaust from a second inlet tube 217 flows through the second balance tube 239 into the middle chamber 233. The exhaust continues to flow through a plurality of perforations 241 or the like formed through the each leg of the baffle portion 225. Excess back pressure in either the first or second chambers will flow into the second or first chambers, respectively.

Figure 33B:
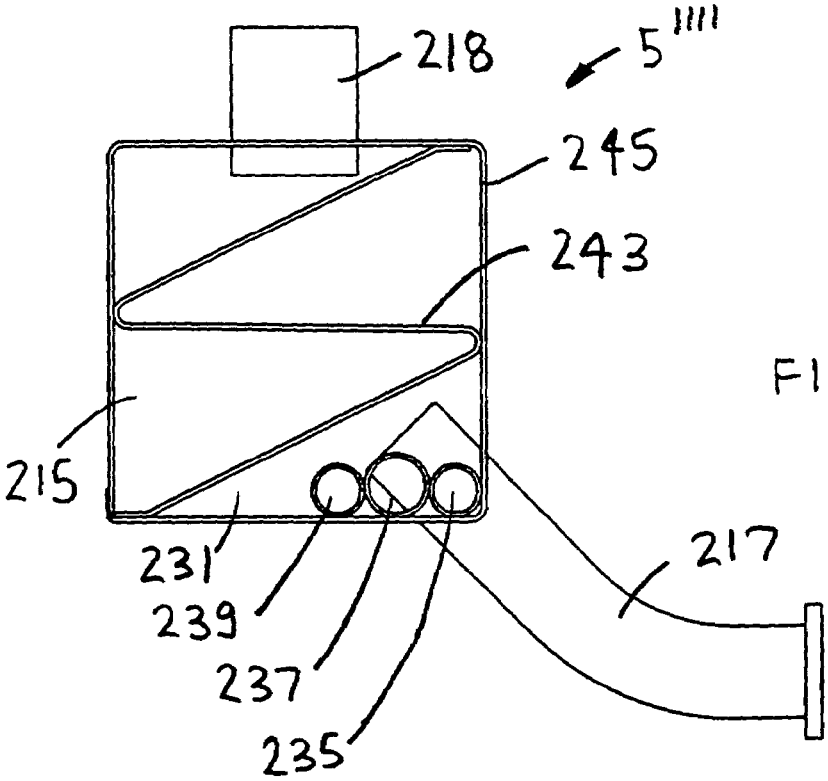
FIG. 33*b* is an end cross sectional view of a fifth embodiment of a muffler with a rectangular shaped container and a Z-shaped baffle fabricated from a single piece of material in accordance with the present invention.

With reference to FIGS. 31–33*b*, a fifth embodiment of the muffler with baffle 5"" includes a one piece baffle 243, a container 245, at least two partitions, two end caps 215, the at least two inlet tubes, at least one outlet tube 218 and at least three balance tubes. A baffle with a "Z" configuration is shown in FIG. 33*b*, but other configurations such as "V" or "W" may also be used. The muffler with baffle 5" " is identical to the muffler with baffle 5"', except that the one piece baffle 243 and the container 245 are not fabricated from a single piece of material.

Figure 34:
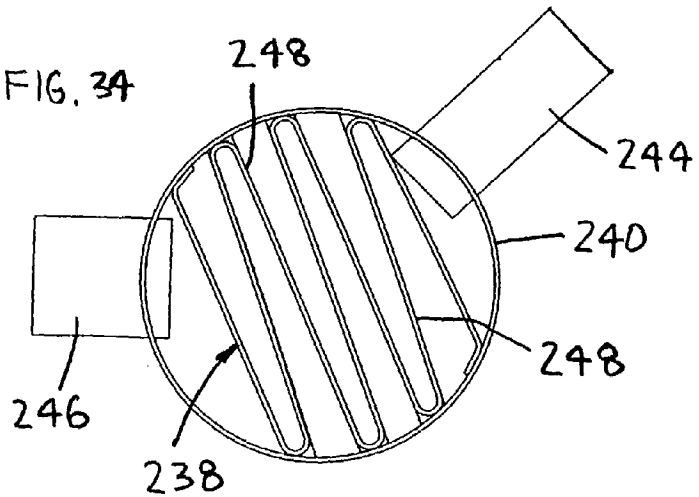
FIG. 34 is an end cross sectional view of a sixth embodiment of a muffler with a one piece corrugated baffle in accordance with the present invention.
Figure 35:
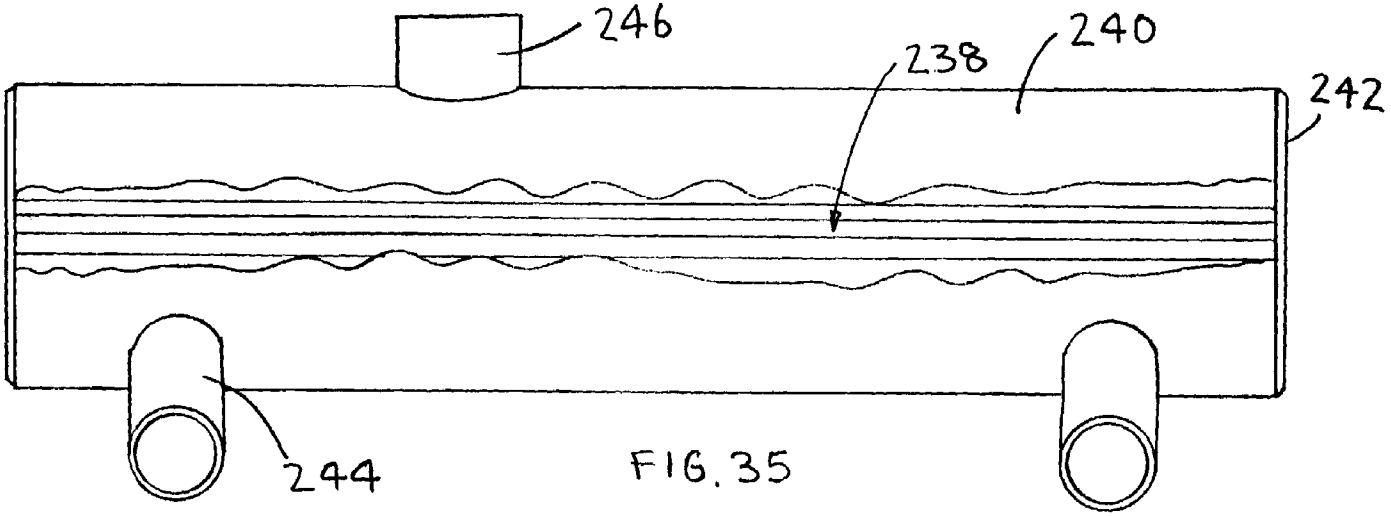
FIG. 35 is a top view of a sixth embodiment of a muffler with a one piece corrugated baffle and a portion of the cover cut-away to reveal the corrugated baffle in accordance with the present invention.

With reference to FIGS. 34–35, a sixth embodiment of the muffler with baffle 6 includes a one piece corrugated baffle 238, a container 240, two end caps 242, at least one inlet tube 244, and at least one outlet tube 246. Each baffle leg 248 of the corrugated baffle 238 includes openings to allow exhaust flow therethrough. The openings include perforations and/or louvers. The one piece corrugated baffle 238 is retained in the container with welding or any other suitable process. The container 240 is terminated by attaching a single end cap 242 to each end thereof. The container 240 preferably has a tubular construction. The at least one inlet tube 244 is inserted through and secured to a wall of the container 240. The at least one outlet tube 246 is inserted through and secured to a wall of the container 240, substantially opposite the at least one inlet tube 244.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of forming a muffler with a baffle, comprising the steps of:

providing a single piece of material;

forming a baffle portion having at least two legs, adjacent legs of said at least two legs being oriented at an acute angle to each other out of said single piece of material;

wrapping a remaining portion of said single piece of material around said baffle portion, attaching said single piece of material to itself to form a container portion;

forming at least one inlet and at least one outlet in said container portion;

securing said baffle portion to said container portion; and covering each end of said container portion.

2. The method of forming a muffler with a baffle of claim 1, further comprising the step of:

covering each end of said container portion by attaching an end cap.

3. The method of forming a muffler with a baffle of claim 1, further comprising the step of:

forming at least one first exhaust opening through a first leg and forming at least one second exhaust opening through a second leg of said baffle portion.

4. The method of forming a muffler with a baffle of claim 3, further comprising the step of:

forming at least one third exhaust opening through a third leg of said baffle portion.

5. The method of forming a muffler with a baffle of claim 4, further comprising the step of:

forming at least one fourth exhaust opening through a third leg of said baffle portion.

6. The method of forming a muffler with a baffle of claim 1, further comprising the step of:

forming at least one inlet opening through said container portion, attaching at least one inlet tube to said at least one inlet opening, forming at least one outlet opening through said container portion, attaching at least one outlet tube to said at least one outlet opening.

7. The method of forming a muffler with a baffle of claim 6, further comprising the step of:

inserting said at least one inlet tube through said baffle portion and inserting said at least one outlet tube through said baffle portion.

8. The method of forming a muffler with a baffle of claim 6, further comprising the step of:

inserting said at least one inlet tube partially through said baffle portion and inserting said at least one outlet tube through said baffle portion.

9. The method of forming a muffler with a baffle of claim 1, further comprising the step of:

inserting at least one baffle tube through at least two of said at least two legs and inserting at least one resonator tube in at least one of said at least two legs.

10. The method of forming a muffler with a baffle of claim 1, further comprising the steps of:

forming a first chamber adjacent a first inlet tube;

forming a second chamber adjacent a second inlet tube, a middle chamber being formed between said first and second chambers;

connecting said first chamber to said middle chamber with a first balance tube;

connecting said second chamber to said middle chamber with a second balance tube; and connecting said first and second chambers with a third balance tube.

11. The method of forming a muffler with a baffle of claim 1, further comprising the step of:

forming a web area between adjacent legs of said at least two legs.

12. A method of forming a muffler with a baffle, comprising the steps of:

forming a baffle having at least two legs, adjacent legs of said at least two legs being oriented at an acute angle to each other;

providing a tubular container, terminating each end of said tubular container with an end cap, said tubular container being sized to receive said baffle;

forming at least one inlet and at least one outlet in said tubular container, an inlet axis of said at least one inlet having an angular relationship to an outlet axis of said at least one outlet; and securing said baffle to said container.

13. The method of forming a muffler with a baffle of claim 12, further comprising the step of:

forming at least one first exhaust opening through a first leg and forming at least one second exhaust opening through a second leg of said baffle.

14. The method of forming a muffler with a baffle of claim 13, further comprising the step of:

forming at least one third exhaust opening through a third leg of said baffle.

15. The method of forming a muffler with a baffle of claim 14, further comprising the step of:

forming at least one fourth exhaust opening through a fourth leg of said baffle.

16. The method of forming a muffler with a baffle of claim 12, further comprising the step of:

forming at least one inlet opening through said container, attaching at least one inlet tube to said at least one inlet opening, forming at least one outlet opening through said container, attaching at least one outlet tube to said at least one outlet opening.

17. The method of forming a muffler with a baffle of claim 16, further comprising the step of:

inserting said at least one inlet tube through said baffle and inserting said at least one outlet tube through said baffle.

18. The method of forming a muffler with a baffle of claim 16, further comprising the step of:

inserting said at least one inlet tube partially through said baffle and inserting said at least one outlet tube through said baffle.

19. The method of forming a muffler with a baffle of claim 12, further comprising the step of:

inserting at least one baffle tube through at least two of said at least two legs and inserting at least one resonator tube in at least one of said at least two legs.

20. The method of forming a muffler with a baffle of claim 12, further comprising the steps of:

forming a first chamber adjacent a first inlet tube;

forming a second chamber adjacent a second inlet tube, a middle chamber being formed between said first and second chambers;

connecting said first chamber to said middle chamber with a first balance tube;

connecting said second chamber to said middle chamber with a second balance tube; and connecting said first and second chambers with a third balance tube.

21. The method of forming a muffler with a baffle of claim 12, further comprising the step of:

forming a web area between adjacent legs of said at least two legs.

22. The method of forming a muffler with a baffle of claim 1, further comprising the step of:

providing said container portion with one of a round and a square cross section.

23. The method of forming a muffler with a baffle of claim 12, further comprising the step of:

providing said container with one of a round and a square cross section.

24. A method of forming a muffler with a baffle, comprising the steps of:

providing a single piece of material;

forming a baffle portion having at least two legs, adjacent legs of said at least two legs being oriented at an acute angle to each other out of said single piece of material;

wrapping a remaining portion of said single piece of material around said baffle portion, attaching said single piece of material to itself to form a container portion;

forming at least one inlet and at least one outlet in said container, an inlet axis of said at least one inlet having an angular relationship to an outlet axis of said at least one outlet;

securing said baffle portion to said container portion; and covering each end of said container portion with an end cap.

25. The method of forming a muffler with a baffle of claim 24, further comprising the step of:

forming at least one first exhaust opening through a first leg and forming at least one second exhaust opening through a second leg of said baffle portion.

26. The method of forming a muffler with a baffle of claim 25, further comprising the step of:

forming at least one third exhaust opening through a third leg of said baffle portion.

27. The method of forming a muffler with a baffle of claim 26, further comprising the step of:

forming at least one fourth exhaust opening through a third leg of said baffle portion.

28. The method of forming a muffler with a baffle of claim 24, further comprising the step of:

forming at least one inlet opening through said container portion, attaching at least one inlet tube to said at least one inlet opening, forming at least one outlet opening through said container portion, attaching at least one outlet tube to said at least one outlet opening.

29. The method of forming a muffler with a baffle of claim 28, further comprising the step of:

inserting said at least one inlet tube through said baffle portion and inserting said at least one outlet tube through said baffle portion.

30. The method of forming a muffler with a baffle of claim 28, further comprising the step of:

inserting said at least one inlet tube partially through said baffle portion and inserting said at least one outlet tube through said baffle portion.

31. The method of forming a muffler with a baffle of claim 24, further comprising the step of:

inserting at least one baffle tube through at least two of said at least two legs and inserting at least one resonator tube in at least one of said at least two legs.

32. The method of forming a muffler with a baffle of claim 24, further comprising the steps of:

forming a first chamber adjacent a first inlet tube;

forming a second chamber adjacent a second inlet tube, a middle chamber being formed between said first and second chambers;

connecting said first chamber to said middle chamber with a first balance tube;

connecting said second chamber to said middle chamber with a second balance tube; and connecting said first and second chambers with a third balance tube.

33. The method of forming a muffler with a baffle of claim 24, further comprising the step of:

forming a web area between adjacent legs of said at least two legs.

34. The method of forming a muffler with a baffle of claim 1, further comprising the step of:

providing said container portion with one of a round and a square cross section.

* * * * *